US008434758B2

(12) United States Patent
Takeda

(10) Patent No.: US 8,434,758 B2
(45) Date of Patent: May 7, 2013

(54) METHOD AND APPARATUS FOR DETECTING FOLDED CORNER OF SHEET IN SHEET-FED PRINTING PRESS

(75) Inventor: Koji Takeda, Tsukuba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 13/396,690

(22) Filed: Feb. 15, 2012

(65) Prior Publication Data

US 2012/0205863 A1 Aug. 16, 2012

(30) Foreign Application Priority Data

Feb. 16, 2011 (JP) ..... 2011-030522
Feb. 16, 2011 (JP) ..... 2011-030523

(51) Int. Cl.
*B65H 9/00* (2006.01)

(52) U.S. Cl.
USPC ..... 271/240; 271/238

(58) Field of Classification Search ..... 271/238, 271/240; 101/485
See application file for complete search history.

(56) References Cited

U.S. PATENT DOCUMENTS 4,480,546 A * 11/1984 Uno et al. ..... 101/248
4,657,239 A * 4/1987 Ikesue et al. ..... 271/227
6,454,256 B1 * 9/2002 Boguhn et al. ..... 271/238
7,635,123 B2 * 12/2009 Watanabe et al. ..... 271/9.09
7,959,151 B2 * 6/2011 Fukube ..... 271/258.01
2005/0056180 A1 * 3/2005 Noda et al. ..... 101/484

FOREIGN PATENT DOCUMENTS

EP 0 317 655 A1 5/1989
EP 1 970 335 A2 9/2008
JP 57-95463 A 6/1982
JP 58011445 A * 1/1983
JP 61-38159 3/1986
JP 63-71049 A 3/1988

OTHER PUBLICATIONS

Extended European Search Report dated Jun. 14, 2012.

* cited by examiner

*Primary Examiner* — Jeremy R Severson
(74) *Attorney, Agent, or Firm* — Birch, Stewart, Kolasch & Birch, LLP

(57) ABSTRACT

A method and an apparatus for detecting a folded corner of a sheet in a sheet-fed printing press automatically select which of a pair of folded corner detectors provided integrally with right and left side lay devices should be used, in accordance with a setting of which of the side lay devices is to be used, thereby making it possible to raise the rate of operation and lightening the burden on an operator. When the left-hand side lay device is used, a first left-hand end detector supported in the left-hand side lay device and a second right-hand end detector supported in the right-hand side lay device are actuated. When the right-hand side lay device is used, a first right-hand end detector supported in the right-hand side lay device and a second left-hand end detector supported in the left-hand side lay device are actuated.

8 Claims, 14 Drawing Sheets

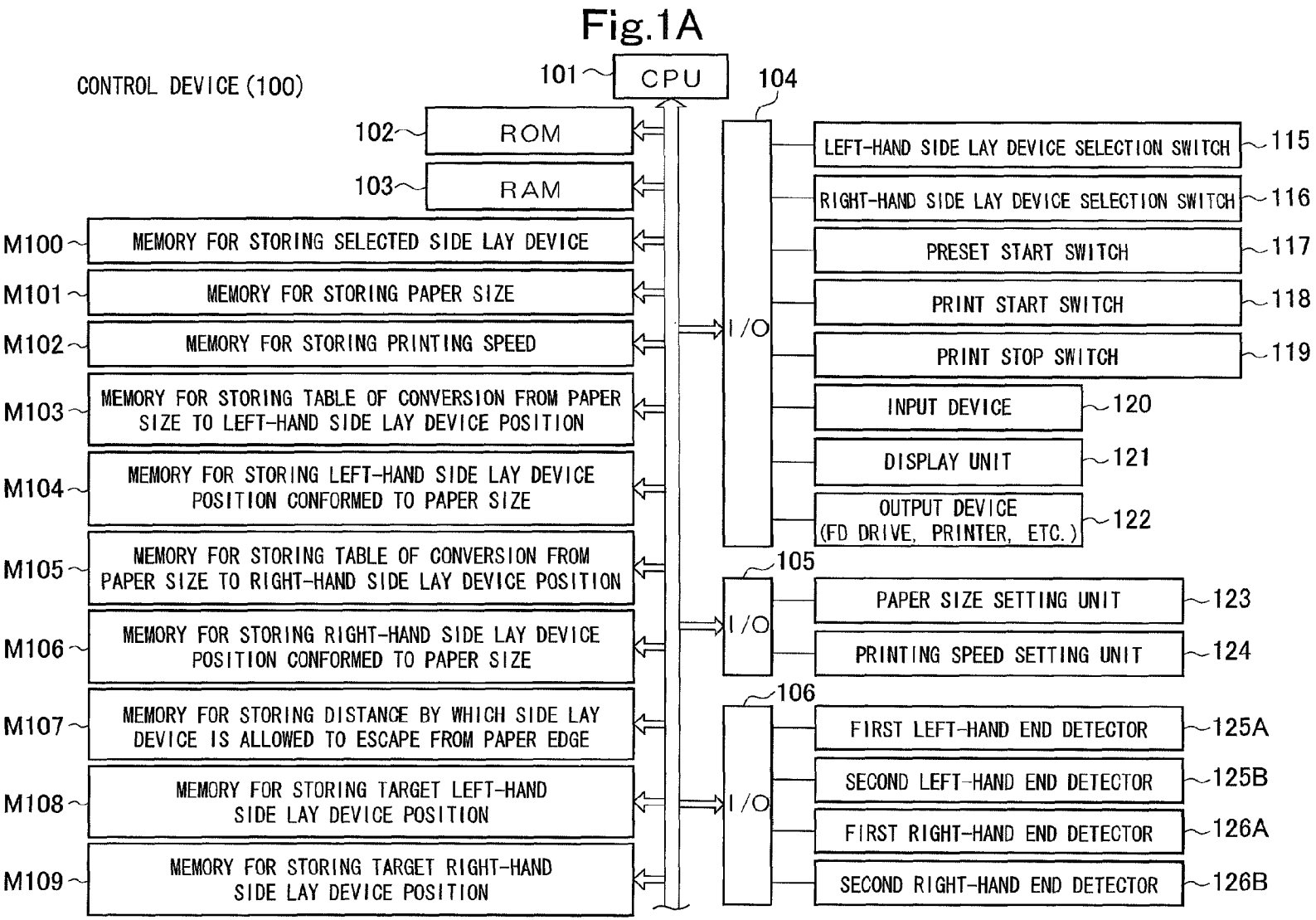
Fig.1A
CONTROL DEVICE (100)
101
CPU
102
ROM
103
RAM
104
I/O
105
I/O
106
I/O
115
LEFT-HAND SIDE LAY DEVICE SELECTION SWITCH
116
RIGHT-HAND SIDE LAY DEVICE SELECTION SWITCH
117
PRESET START SWITCH
118
PRINT START SWITCH
119
PRINT STOP SWITCH
120
INPUT DEVICE
121
DISPLAY UNIT
122
OUTPUT DEVICE (FD DRIVE, PRINTER, ETC.)
123
PAPER SIZE SETTING UNIT
124
PRINTING SPEED SETTING UNIT
125A
FIRST LEFT-HAND END DETECTOR
125B
SECOND LEFT-HAND END DETECTOR
126A
FIRST RIGHT-HAND END DETECTOR
126B
SECOND RIGHT-HAND END DETECTOR
M100
MEMORY FOR STORING SELECTED SIDE LAY DEVICE
M101
MEMORY FOR STORING PAPER SIZE
M102
MEMORY FOR STORING PRINTING SPEED
M103
MEMORY FOR STORING TABLE OF CONVERSION FROM PAPER SIZE TO LEFT-HAND SIDE LAY DEVICE POSITION
M104
MEMORY FOR STORING LEFT-HAND SIDE LAY DEVICE POSITION CONFORMED TO PAPER SIZE
M105
MEMORY FOR STORING TABLE OF CONVERSION FROM PAPER SIZE TO RIGHT-HAND SIDE LAY DEVICE POSITION
M106
MEMORY FOR STORING RIGHT-HAND SIDE LAY DEVICE POSITION CONFORMED TO PAPER SIZE
M107
MEMORY FOR STORING DISTANCE BY WHICH SIDE LAY DEVICE IS ALLOWED TO ESCAPE FROM PAPER EDGE
M108
MEMORY FOR STORING TARGET LEFT-HAND SIDE LAY DEVICE POSITION
M109
MEMORY FOR STORING TARGET RIGHT-HAND SIDE LAY DEVICE POSITION

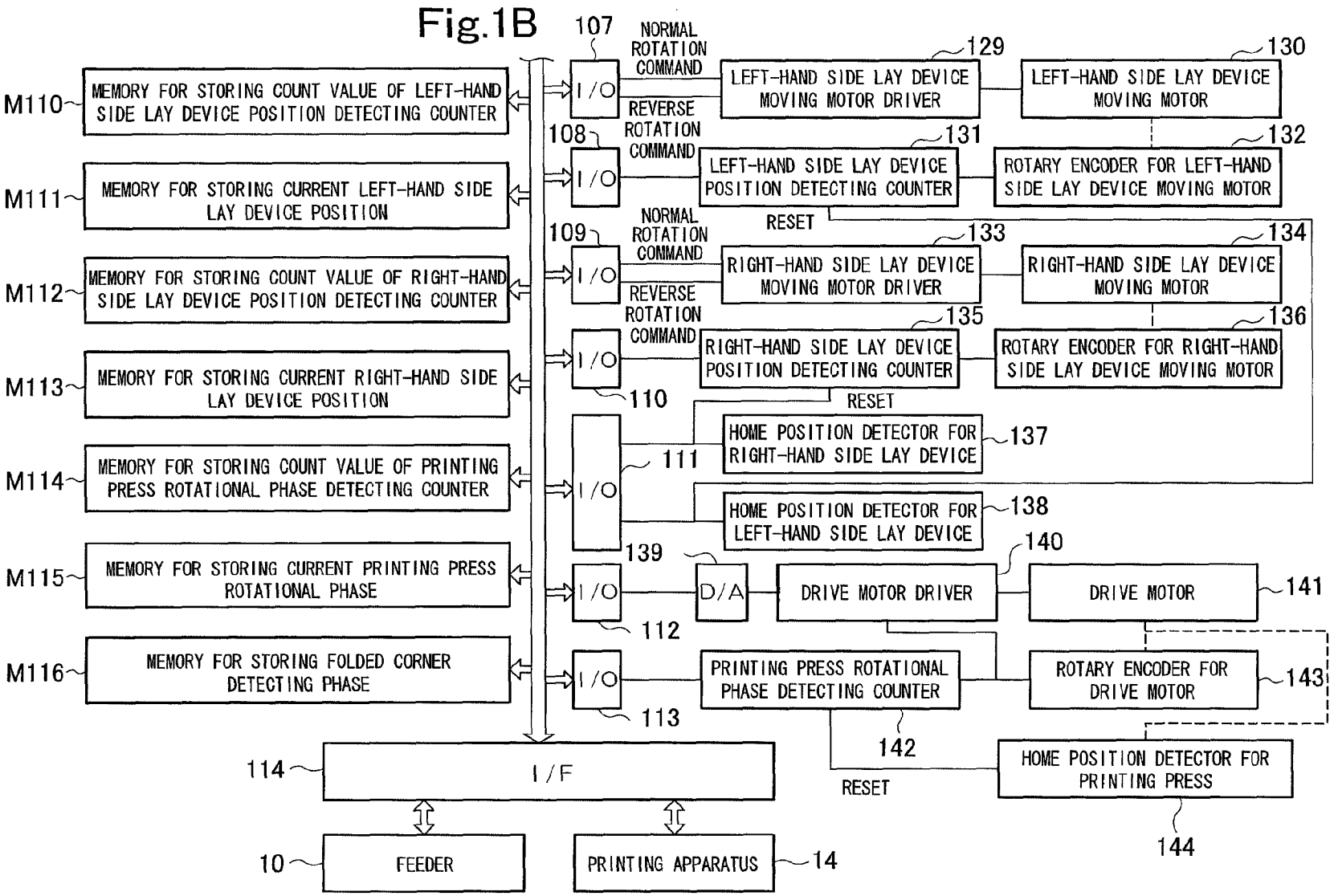
Fig.1B
LEFT-HAND SIDE LAY DEVICE MOVING MOTOR
130
ROTARY ENCODER FOR LEFT-HAND SIDE LAY DEVICE MOVING MOTOR
132
RIGHT-HAND SIDE LAY DEVICE MOVING MOTOR
134
ROTARY ENCODER FOR RIGHT-HAND SIDE LAY DEVICE MOVING MOTOR
136
DRIVE MOTOR
141
ROTARY ENCODER FOR DRIVE MOTOR
143
HOME POSITION DETECTOR FOR PRINTING PRESS
144
LEFT-HAND SIDE LAY DEVICE MOVING MOTOR DRIVER
129
LEFT-HAND SIDE LAY DEVICE POSITION DETECTING COUNTER
131
RIGHT-HAND SIDE LAY DEVICE MOVING MOTOR DRIVER
133
RIGHT-HAND SIDE LAY DEVICE POSITION DETECTING COUNTER
135
HOME POSITION DETECTOR FOR RIGHT-HAND SIDE LAY DEVICE
137
HOME POSITION DETECTOR FOR LEFT-HAND SIDE LAY DEVICE
138
DRIVE MOTOR DRIVER
140
PRINTING PRESS ROTATIONAL PHASE DETECTING COUNTER
142
RESET
NORMAL ROTATION COMMAND
REVERSE ROTATION COMMAND
I/O
107
108
109
110
111
112
113
D/A
139
I/F
114
PRINTING APPARATUS
14
FEEDER
10
MEMORY FOR STORING COUNT VALUE OF LEFT-HAND SIDE LAY DEVICE POSITION DETECTING COUNTER
M110
MEMORY FOR STORING CURRENT LEFT-HAND SIDE LAY DEVICE POSITION
M111
MEMORY FOR STORING COUNT VALUE OF RIGHT-HAND SIDE LAY DEVICE POSITION DETECTING COUNTER
M112
MEMORY FOR STORING CURRENT RIGHT-HAND SIDE LAY DEVICE POSITION
M113
MEMORY FOR STORING COUNT VALUE OF PRINTING PRESS ROTATIONAL PHASE DETECTING COUNTER
M114
MEMORY FOR STORING CURRENT PRINTING PRESS ROTATIONAL PHASE
M115
MEMORY FOR STORING FOLDED CORNER DETECTING PHASE
M116

METHOD AND APPARATUS FOR DETECTING FOLDED CORNER OF SHEET IN SHEET-FED PRINTING PRESS

BACKGROUND OF THE INVENTION

1. Field of the Invention

The present invention relates to a method and an apparatus for detecting a folded corner of a sheet which stops upon contact with front lays at the tip of a feedboard in a sheet-fed printing press.

2. Description of the Related Art

With a sheet-fed printing press, sheets stacked on a pile board of a feeder are sucked, one by one, out of an upper part of the stack by a suction device, and fed out onto a feeder board. The sheet is further fed out onto the feedboard by a transport tape and a feeding roller. This sheet has its circumferential position registered by the front lays at the tip of the feedboard and stopped in this state, and also has its lateral position registered by a side lay device. The sheet which has stopped upon contact with the front lays is gripped and transported by grippers of a swing arm shaft pregripper, is then gripped, for gripping change, by grippers of an impression cylinder of a printing unit, and is printed while being transported.

The sheets which are thus supplied to the printing unit need to be supplied, one by one, without being distorted or folded. If an improper sheet feed such as a corner fold or a double-sheet feed happens, therefore, it is detected, and gripping by the grippers or feeding onto the feedboard is stopped. The corner-folded sheet among such improperly fed sheets is a sheet having the right corner (right end) or the left corner (left end) of its front edge (front endpart) folded in a triangular shape. To detect this folded corner, it has been common practice to provide a photoelectric detector above a position several millimeters ahead of the front lays, detect whether or not there is reflected light from the sheet stopping when contacting the front lays, and judge that the sheet is folded, in the absence of the reflected light, thereby detecting the folded corner. If the sheet size changes, the detector is moved.

CITATION LIST

Patent Literature

Patent Document JP-A-57-95463
Patent Document JP-A-63-71049
Patent Document JP-UM-A-61-38159

SUMMARY OF INVENTION

Technical Problem

With the conventional detector (sensor), however, a pair of the detectors (right detector and left detector) are fixed by screws to a rod extending in the lateral direction, as described in Patent Document 1. Thus, whenever the size of the sheet is changed, the screws are loosened, and the lateral positions of the respective detectors are adjusted such that the detectors are positioned at the corners on both sides in the lateral direction of the sheet. Then, the screws are tightened to fix the detectors in place.

Thus, the problems have been posed that the position adjustment of each detector takes time, lowering the rate of operation and burdening an operator.

Under these circumstances, it is conceivable, as disclosed in Patent Document 2, to support detectors by side lay devices which are provided as a pair in the lateral direction at positions close to the detectors and whose positions in the lateral direction are automatically adjusted in accordance with the paper size of the sheet; and adjust the lateral positions of the detectors simultaneously with the side lay devices. The problem arises, however, that only one of the pair of side lay devices is always used, whereas the other side lay device is positioned at a retreat position so as not to impede the feeding of the sheet to the printing unit, so that the corner of the sheet facing the other side lay device cannot be detected.

The present invention has been proposed in the light of the above-described situations. It is a first object of the present invention, therefore, to provide a method and an apparatus for detecting a folded corner of a sheet in a sheet-fed printing press, which are designed to automatically select which of a pair of folded corner detectors provided integrally with right and left side lay devices should be used, in accordance with a setting of which of the side lay devices is to be used, thereby making it possible to raise the rate of operation and lightening the burden on the operator.

It is a second object of the present invention to provide a method and an apparatus for detecting a folded corner of a sheet in a sheet-fed printing press, which are designed to automatically move the detector, which detects the folded corner of the sheet, to the position of detection with the effective use of the side lay device when changing the paper size of the sheet, thereby making it possible to raise the rate of operation and lightening the burden on the operator.

Solution to Problem

A method for detecting a folded corner of a sheet in a sheet-fed printing press, intended to solve the above-mentioned problems, is a method for detecting a folded corner of a sheet in a sheet-fed printing press, the sheet-fed printing press including:

a left-hand side lay device for registering a left end position of sheets supplied from a feeder to a printing unit, a right-hand side lay device for registering a right end position of sheets supplied from the feeder to the printing unit, and a detector for detecting presence or absence of the sheet at a left end part and a right end part of a front end of the sheet whose position has been registered by one of the side lay devices, the method comprising providing the detector composed of:

a first left-hand end detector supported in the left-hand side lay device, a second left-hand end detector supported in the left-hand side lay device and provided at a position spaced from the first left-hand end detector toward a center in a lateral direction, a first right-hand end detector supported in the right-hand side lay device, and a second right-hand end detector supported in the right-hand side lay device and provided at a position spaced from the first right-hand end detector toward the center in the lateral direction, wherein if the left-hand side lay device is selected among a pair of the side lay devices, the first left-hand end detector supported in the left-hand side lay device and the second right-hand end detector supported in the right-hand side lay device detect the presence or absence of the sheet at the left end part and the right end part of the front end of the sheet, or if the right-hand side lay device is selected, the first right-hand end detector supported in the right-hand side lay device and the second left-hand end detector supported in the left-hand side lay device detect the presence or absence of the sheet at the right end part and the left end part of the front end of the sheet.

The method for detecting a folded corner of a sheet in a sheet-fed printing press further comprises providing a left-hand side lay device moving mechanism for moving the left-hand side lay device in the lateral direction, a left-hand side lay device moving drive source for driving the left-hand side lay device moving mechanism, a right-hand side lay device moving mechanism for moving the right-hand side lay device in the lateral direction, and a right-hand side lay device moving drive source for driving the right-hand side lay device moving mechanism, and is characterized in that if the left-hand side lay device is selected among the pair of the side lay devices, the first left-hand end detector supported in the left-hand side lay device and the second right-hand end detector supported in the right-hand side lay device detect the presence or absence of the sheet at the left end part and the right end part of the front end of the sheet, the left-hand side lay device moving drive source moves the left-hand side lay device to a position conformed to a length in the lateral direction of the sheet, and the right-hand side lay device moving drive source moves the right-hand side lay device to a position where the second right-hand end detector can detect the right end part of the sheet; or if the right-hand side lay device is selected, the first right-hand end detector supported in the right-hand side lay device and the second left-hand end detector supported in the left-hand side lay device detect the presence or absence of the sheet at the right end part and the left end part of the front end of the sheet, the right-hand side lay device moving drive source moves the right-hand side lay device to a position conformed to the length in the lateral direction of the sheet, and the left-hand side lay device moving drive source moves the left-hand side lay device to a position where the second left-hand end detector can detect the left end part of the sheet.

The method for detecting a folded corner of a sheet in a sheet-fed printing press is characterized in that the position of the right-hand side lay device if the left-hand side lay device is selected is a position defined by (the position of the right-hand side lay device conformed to the length in the lateral direction of the sheet)−(a distance in the lateral direction between the first right-hand end detector and the second right-hand end detector) and the position of the left-hand side lay device if the right-hand side lay device is selected is a position defined by {(the position of the left-hand side lay device conformed to the length in the lateral direction of the sheet)−(a distance in the lateral direction between the first left-hand end detector and the second left-hand end detector)}.

The method for detecting a folded corner of a sheet in a sheet-fed printing press is characterized in that a distance in the lateral direction between the first right-hand end detector and the second right-hand end detector is a distance by which the right-hand side lay device is allowed to escape from a right edge of the registered sheet if the left-hand side lay device is selected, and a distance in the lateral direction between the first left-hand end detector and the second left-hand end detector is a distance by which the left-hand side lay device is allowed to escape from a left edge of the registered sheet if the right-hand side lay device is selected.

An apparatus for detecting a folded corner of a sheet in a sheet-fed printing press, intended to solve the above problems, is an apparatus for detecting a folded corner of a sheet in a sheet-fed printing press, the sheet-fed printing press including a left-hand side lay device for registering a left end position of sheets supplied from a feeder to a printing unit, a right-hand side lay device for registering a right end position of sheets supplied from the feeder to the printing unit, and a detector for detecting presence or absence of the sheet at a left end part and a right end part of a front end of the sheet whose position has been registered by one of the side lay devices, the apparatus comprising the detector composed of a first left-hand end detector supported in the left-hand side lay device, a second left-hand end detector supported in the left-hand side lay device and provided at a position spaced from the first left-hand end detector toward a center in a lateral direction, a first right-hand end detector supported in the right-hand side lay device, and a second right-hand end detector supported in the right-hand side lay device and provided at a position spaced from the first right-hand end detector toward the center in the lateral direction, the apparatus further comprising a control device which exercises control such that if the left-hand side lay device is selected among a pair of the side lay devices, the first left-hand end detector supported in the left-hand side lay device and the second right-hand end detector supported in the right-hand side lay device detect the presence or absence of the sheet at the left end part and the right end part of the front end of the sheet, or if the right-hand side lay device is selected, the first right-hand end detector supported in the right-hand side lay device and the second left-hand end detector supported in the left-hand side lay device detect the presence or absence of the sheet at the right end part and the left end part of the front end of the sheet.

The apparatus for detecting a folded corner of a sheet in a sheet-fed printing press further comprises a left-hand side lay device moving mechanism for moving the left-hand side lay device in the lateral direction, a left-hand side lay device moving drive source for driving the left-hand side lay device moving mechanism, a right-hand side lay device moving mechanism for moving the right-hand side lay device in the lateral direction, and a right-hand side lay device moving drive source for driving the right-hand side lay device moving mechanism, and is characterized in that if the left-hand side lay device is selected among the pair of the side lay devices, the control device detects the presence or absence of the sheet at the left end part and the right end part of the front end of the sheet based on signals from the first left-hand end detector supported in the left-hand side lay device and the second right-hand end detector supported in the right-hand side lay device, drivingly controls the left-hand side lay device moving drive source to move the left-hand side lay device to a position conformed to a length in the lateral direction of the sheet, and drivingly controls the right-hand side lay device moving drive source to move the right-hand side lay device to a position where the second right-hand end detector can detect the right end part of the sheet; or if the right-hand side lay device is selected, the control device detects the presence or absence of the sheet at the right end part and the left end part of the front end of the sheet based on signals from the first right-hand end detector supported in the right-hand side lay device and the second left-hand end detector supported in the left-hand side lay device, drivingly controls the right-hand side lay device moving drive source to move the right-hand side lay device to a position conformed to the length in the lateral direction of the sheet, and drivingly controls the left-hand side lay device moving drive source to move the left-hand side lay device to a position where the second left-hand end detector can detect the left end part of the sheet.

The apparatus for detecting a folded corner of a sheet in a sheet-fed printing press is characterized in that the control device drivingly controls the left-hand side lay device moving drive source and the right-hand side lay device moving drive source such that the position of the right-hand side lay device if the left-hand side lay device is selected is a position defined by {(the position of the right-hand side lay device conformed to the length in the lateral direction of the sheet)−(a distance in the lateral direction between the first right-hand end detector and the second right-hand end detector)}, and the position of the left-hand side lay device if the right-hand side lay device is selected is a position defined by {(the position of the left-hand side lay device conformed to the length in the lateral direction of the sheet)−(a distance in the lateral direction between the first left-hand end detector and the second left-hand end detector)}.

The apparatus for detecting a folded corner of a sheet in a sheet-fed printing press is characterized in that a distance in the lateral direction between the first right-hand end detector and the second right-hand end detector is a distance by which the right-hand side lay device is allowed to escape from a right edge of the registered sheet if the left-hand side lay device is selected, and a distance in the lateral direction between the first left-hand end detector and the second left-hand end detector is a distance by which the left-hand side lay device is allowed to escape from a left edge of the registered sheet if the right-hand side lay device is selected.

Advantageous Effects of Invention

According to the foregoing method and apparatus for detecting a folded corner of a sheet in a sheet-fed printing press concerned with the present invention, which of the first and second left-hand end detectors should be used, and which of the first and second right-hand end detectors should be used, among the pair of left-hand end detectors and the pair of right-hand end detectors provided integrally with the left-hand and right-hand side lay devices, are automatically selected in accordance with a setting of which of the left-hand and right-hand side lay devices is to be used. Thus, the rate of operation can be increased, and the burden on the operator can be reduced.

Furthermore, the detectors for detecting a folded corner of the sheet are automatically moved to the detecting position by the effective use of the side lay devices when the paper size of the sheet is changed. Thus, the rate of operation can be increased, and the burden on the operator can be reduced.

BRIEF DESCRIPTION OF DRAWINGS

FIG. 1A is a hardware block diagram of a control device for left-hand end detectors, right-hand end detectors, a left-hand side lay device moving motor, and a right-hand side lay device moving motor in an embodiment of the present invention.

FIG. 1B is a hardware block diagram of the control device for the left-hand end detectors, the right-hand end detectors, the left-hand side lay device moving motor, and the right-hand side lay device moving motor in the embodiment of the present invention.

DETAILED DESCRIPTION OF THE INVENTION

Hereinafter, a method and an apparatus for detecting a folded corner of a sheet in a sheet-fed printing press according to the present invention will be described in detail by an embodiment with reference to the accompanying drawings.

Embodiment

Figure 2A:
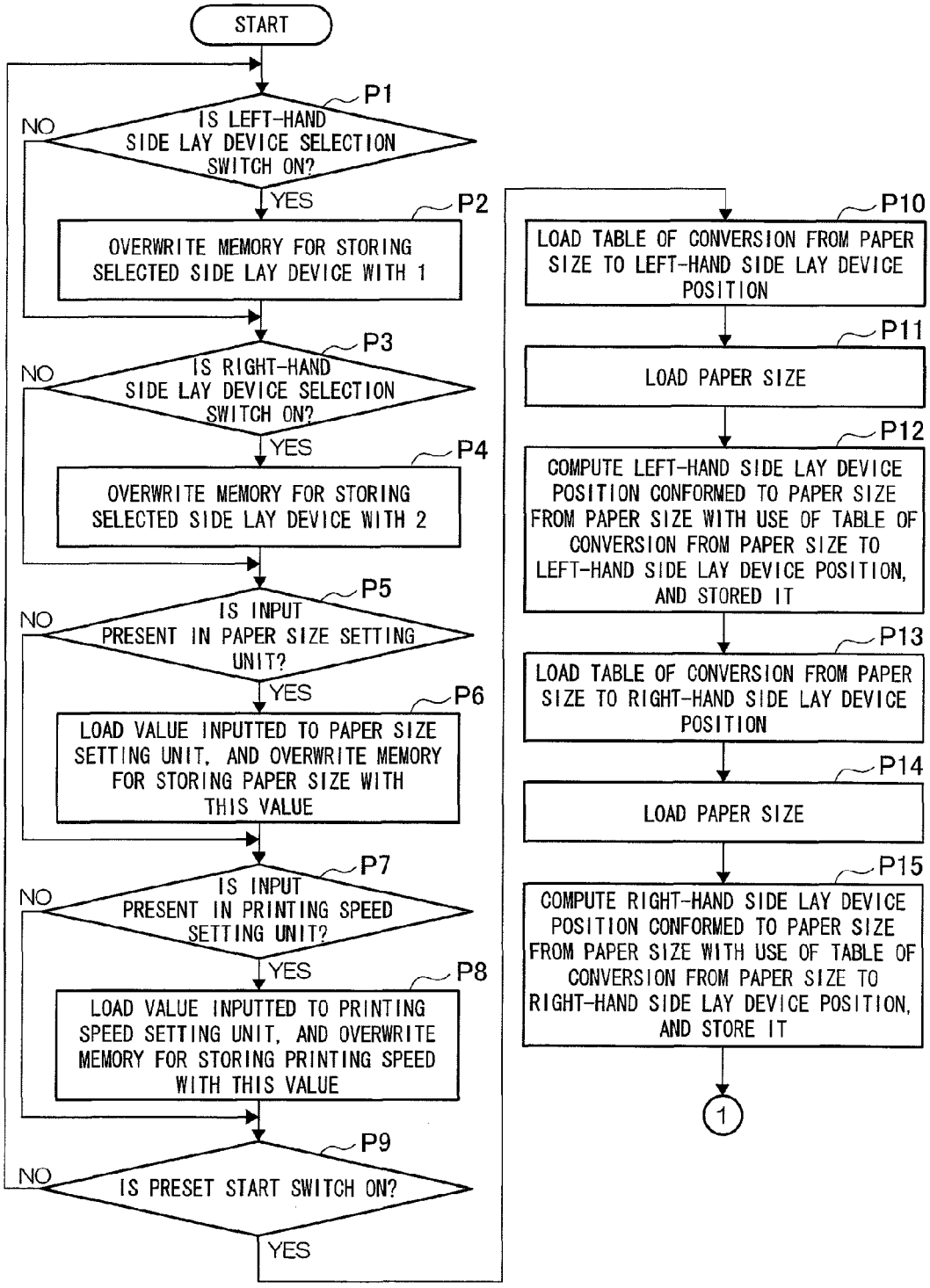
FIG. 2A is an operational or action flow chart of the control device the left-hand end detectors, the right-hand end detectors, the left-hand side lay device moving motor, and the right-hand side lay device moving motor in the embodiment of the present invention.
Figure 2B:
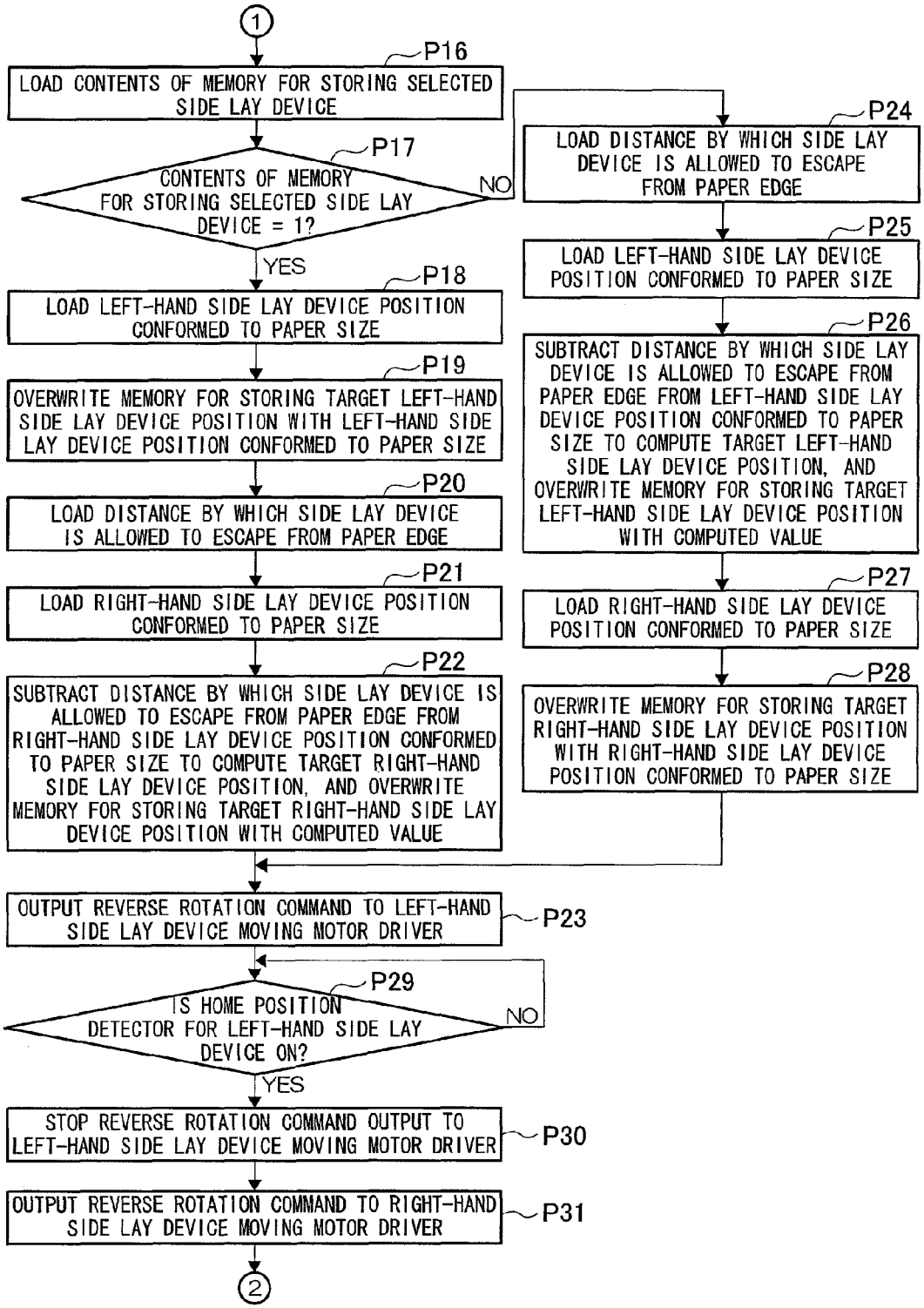
FIG. 2B is an action flow chart of the control device for the left-hand end detectors, the right-hand end detectors, the left-hand side lay device moving motor, and the right-hand side lay device moving motor in the embodiment of the present invention.
Figure 2C:
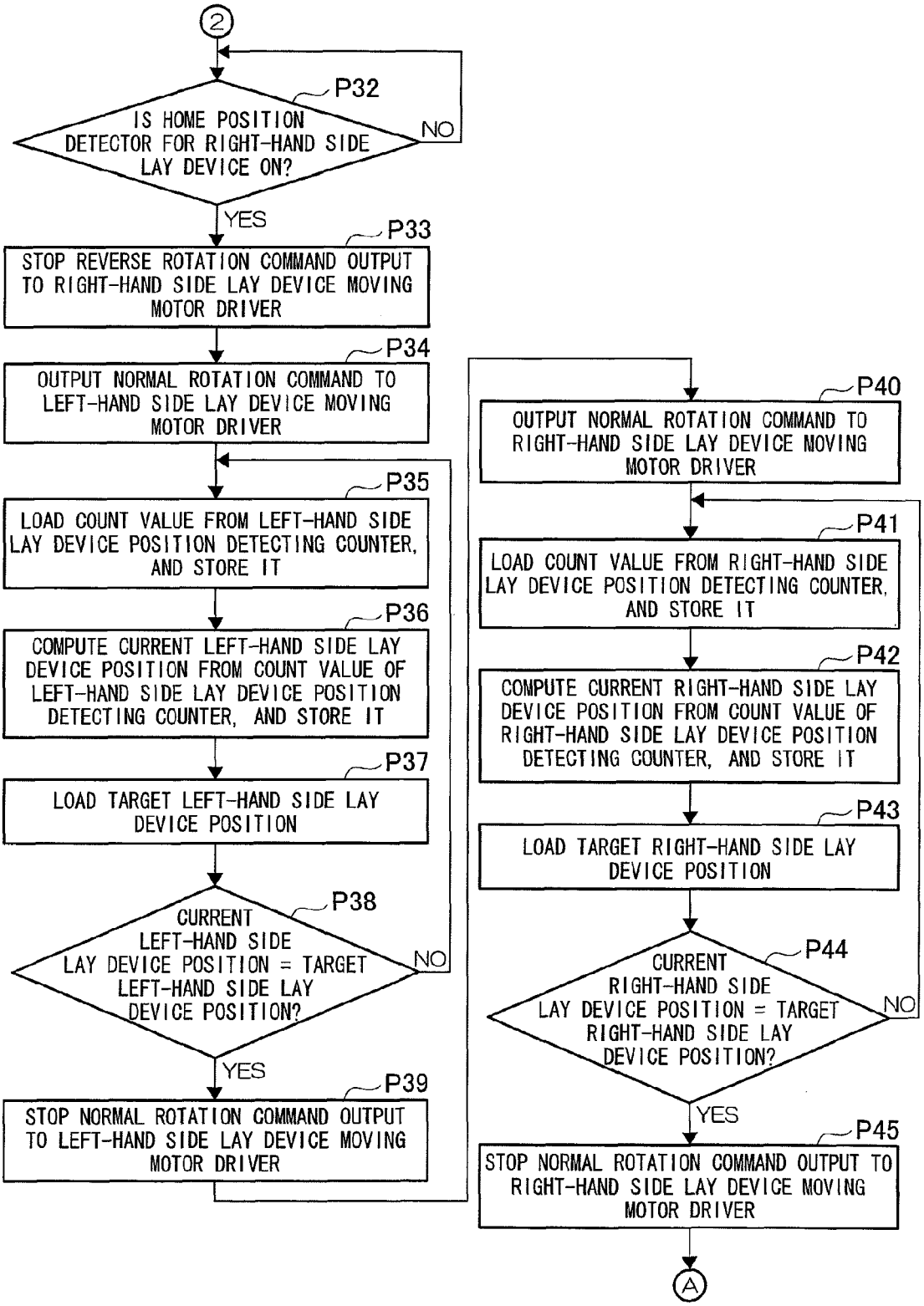
FIG. 2C is an action flow chart of the control device for the left-hand end detectors, the right-hand end detectors, the left-hand side lay device moving motor, and the right-hand side lay device moving motor in the embodiment of the present invention.
Figure 3A:
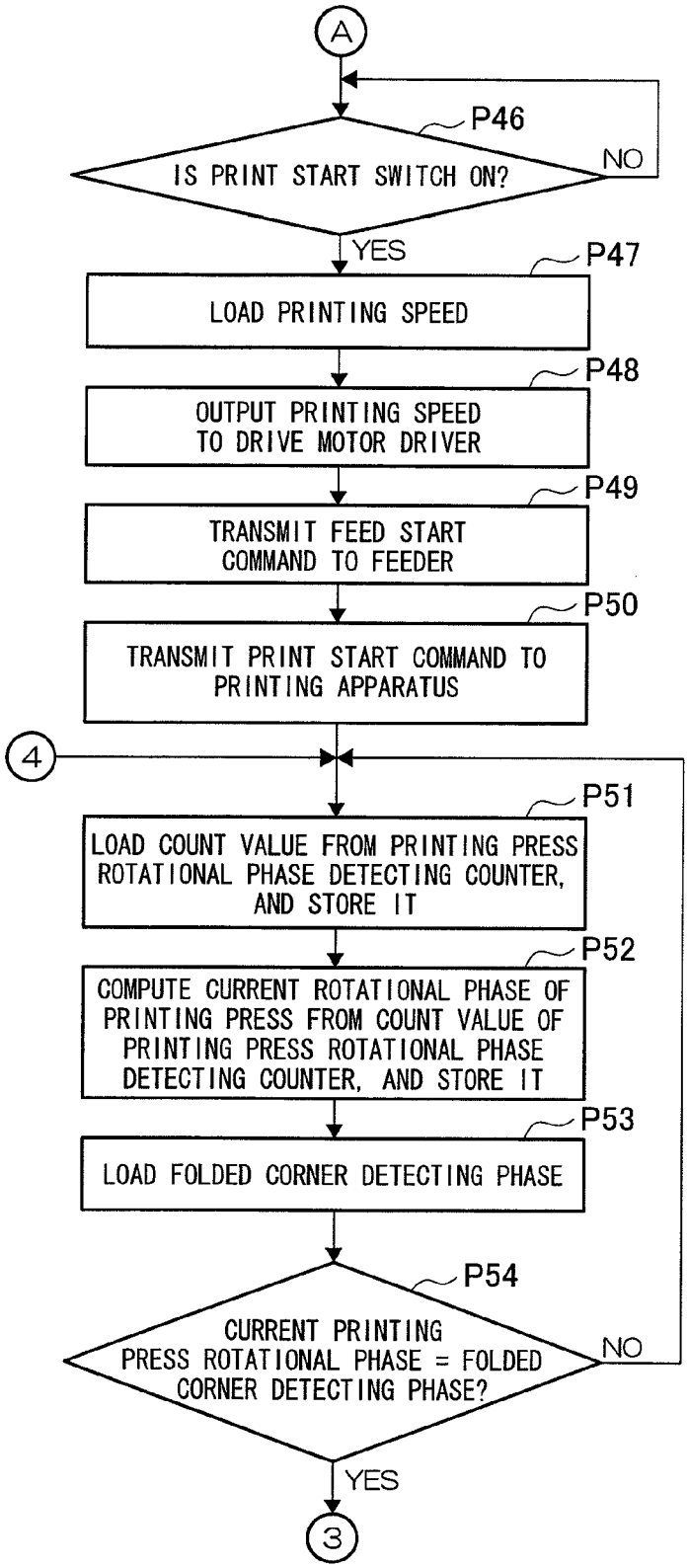
FIG. 3A is an action flow chart of the control device for the left-hand end detectors, the right-hand end detectors, the left-hand side lay device moving motor, and the right-hand side lay device moving motor in the embodiment of the present invention.
Figure 3B:
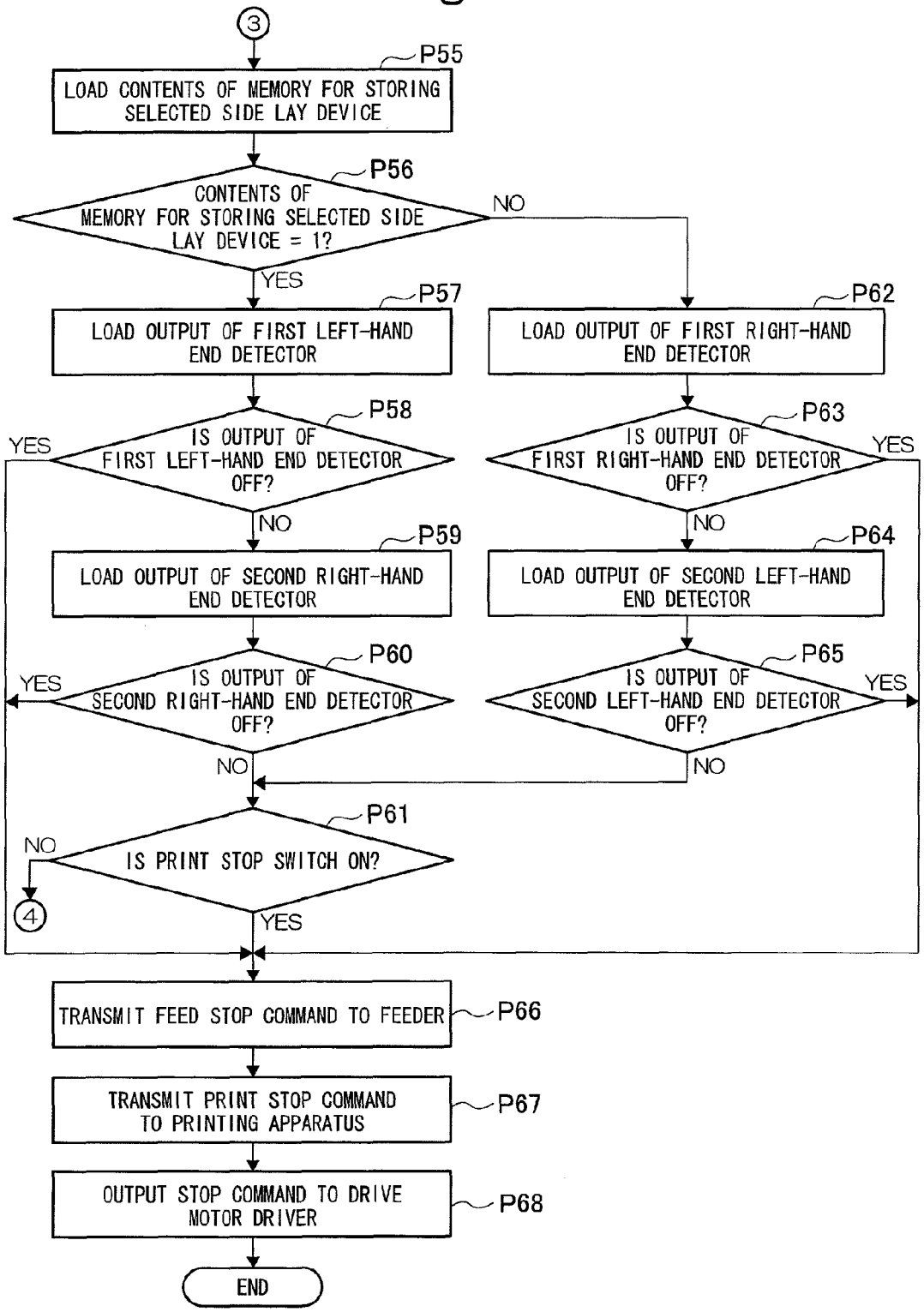
FIG. 3B is an action flow chart of the control device for the left-hand end detectors, the right-hand end detectors, the left-hand side lay device moving motor, and the right-hand side lay device moving motor in the embodiment of the present invention.
Figure 4:
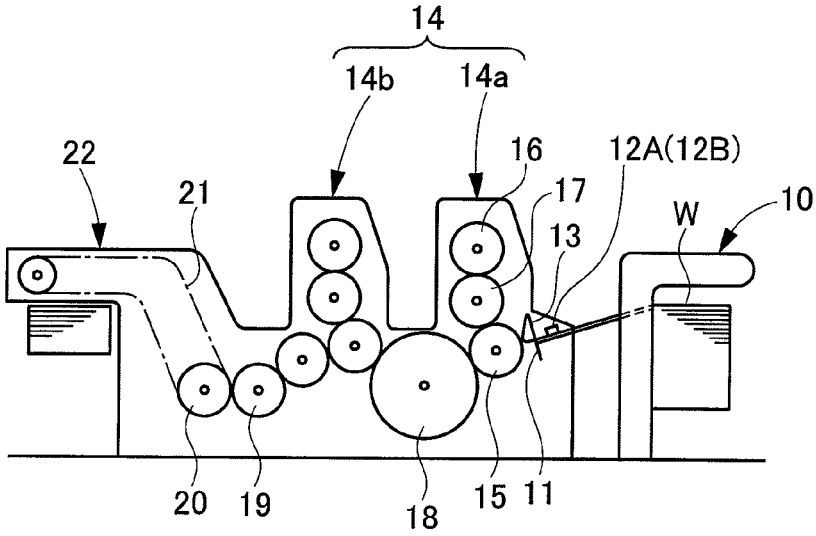
FIG. 4 is a schematic configurational drawing of a sheet-fed printing press.
Figure 5:
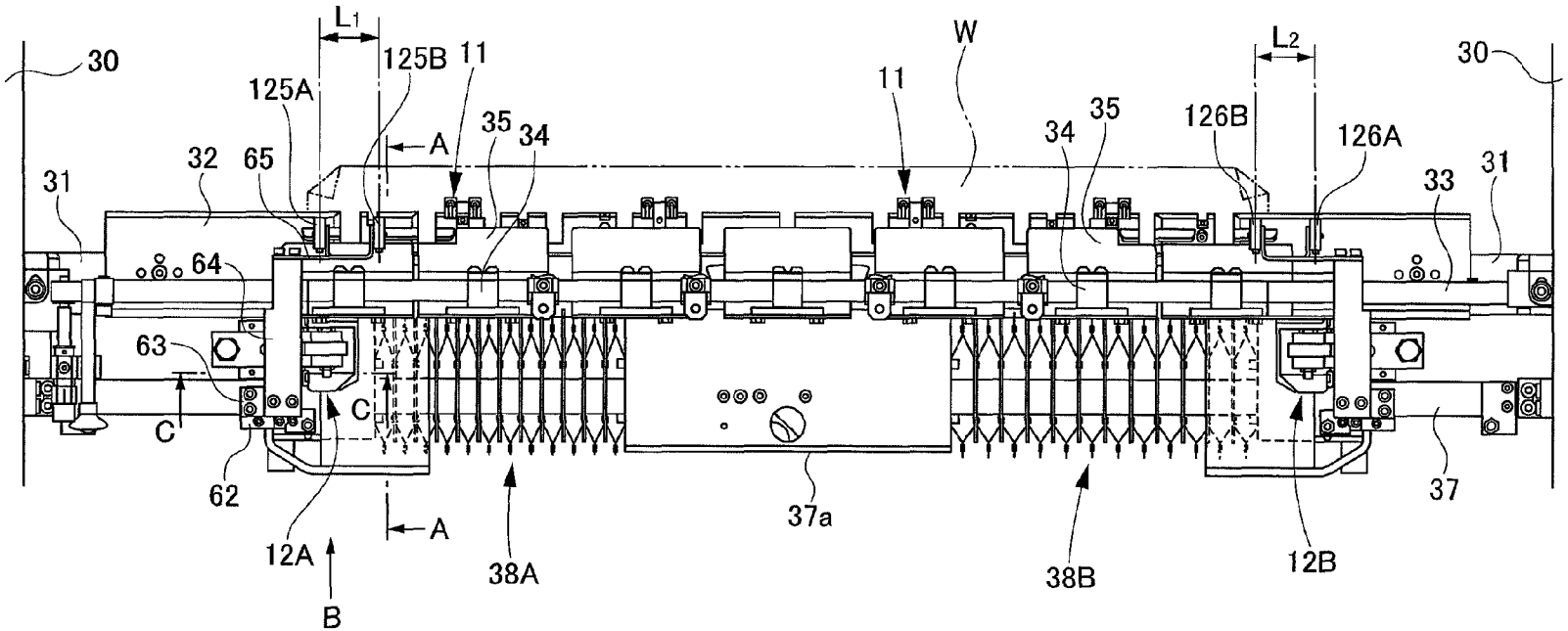
FIG. 5 is a plan view of a registering section.
Figure 6:
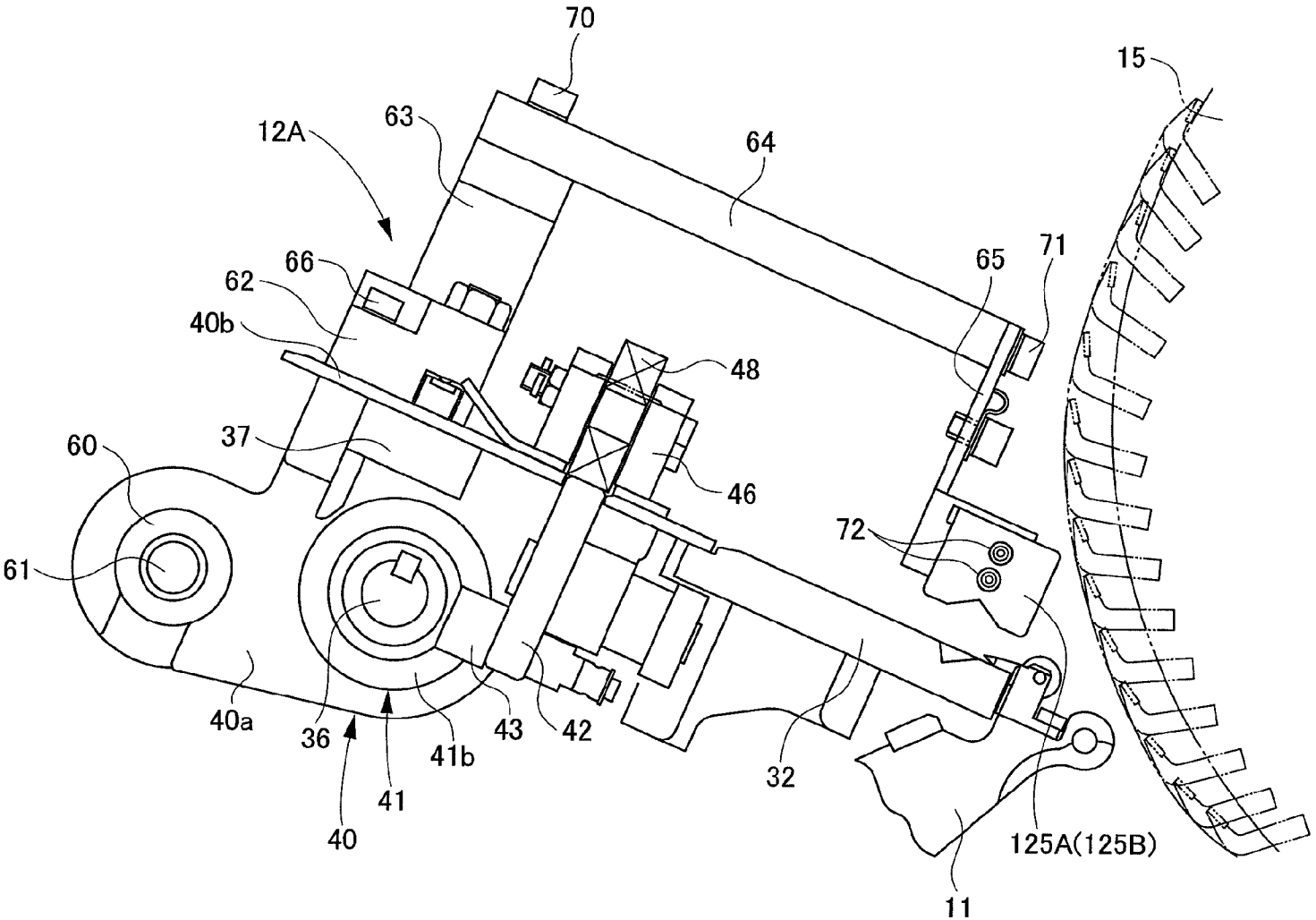
FIG. 6 is a sectional view taken on line A-A in FIG. 5.
Figure 7:
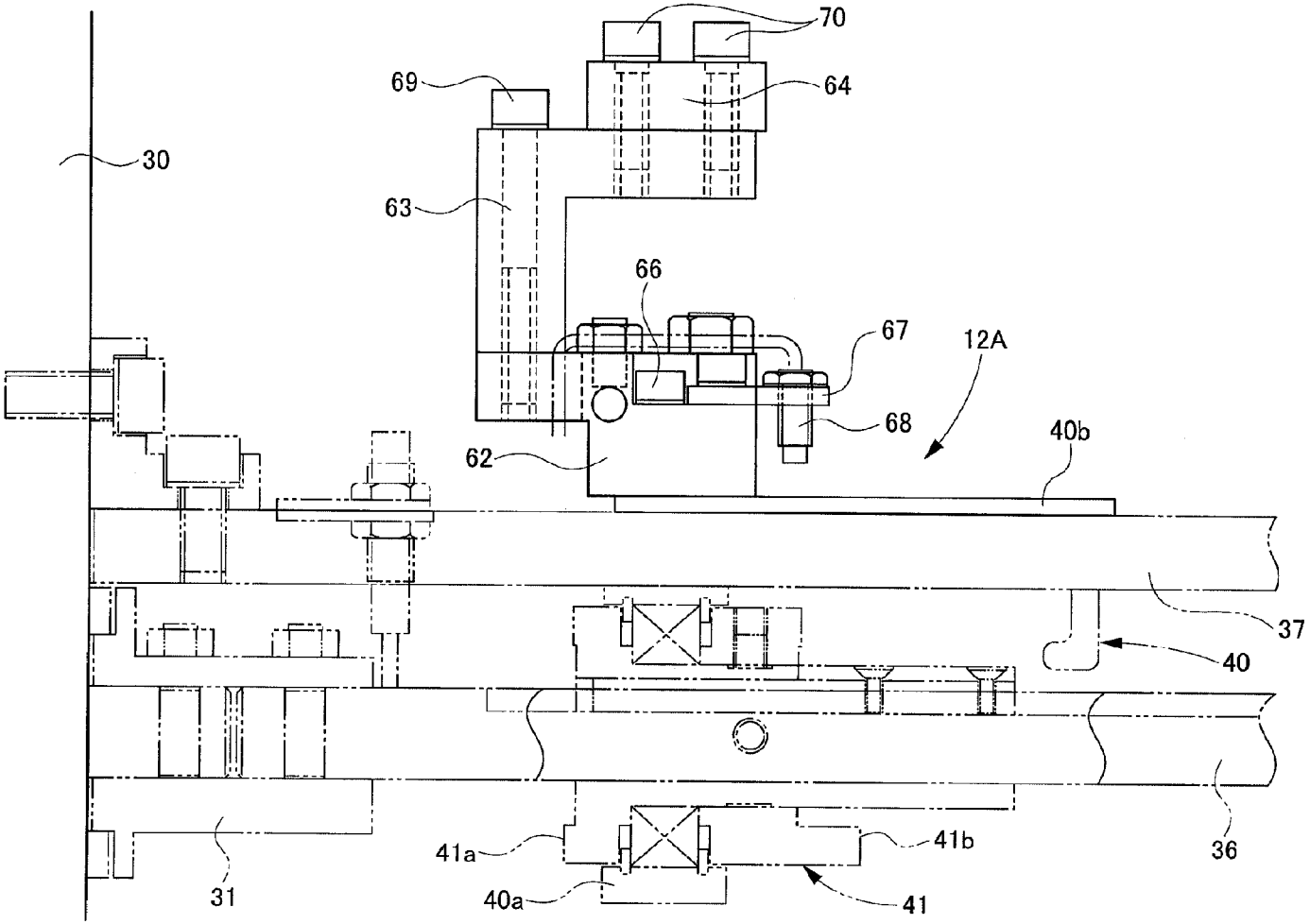
FIG. 7 is a view taken in the direction of an arrow B in FIG. 5.
Figure 8:
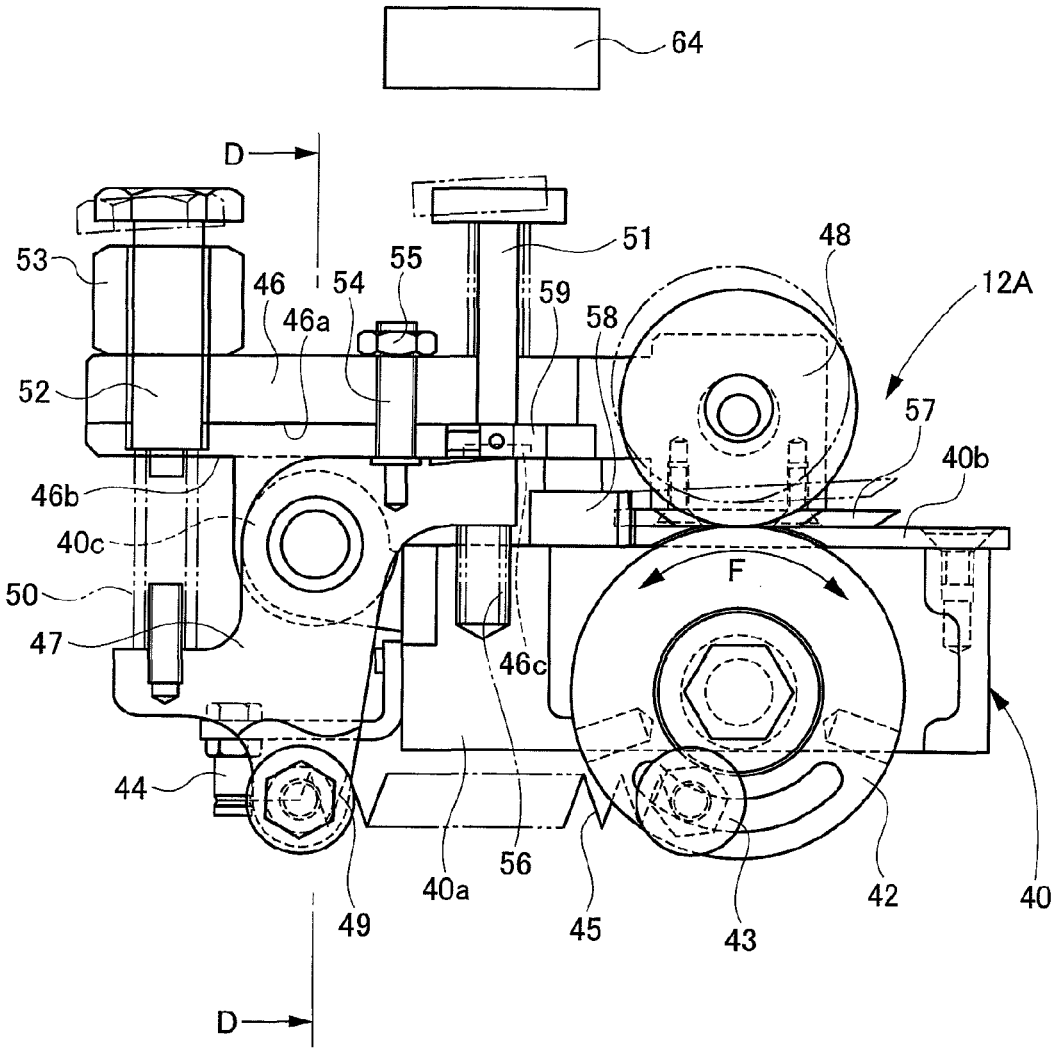
FIG. 8 is a sectional view taken on line C-C in FIG. 5.
Figure 9:
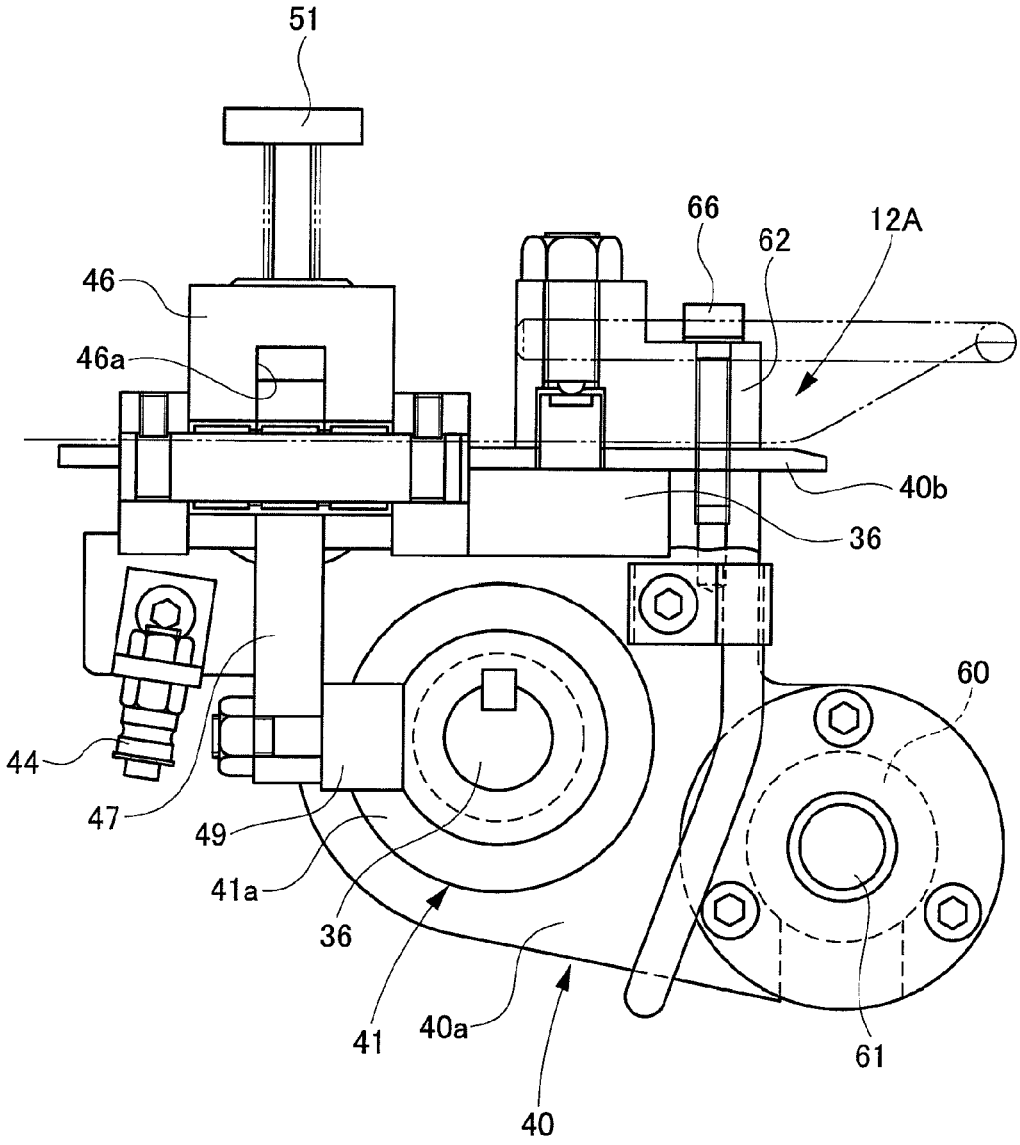
FIG. 9 is a sectional view taken on line D-D in FIG. 8.
Figure 10A:
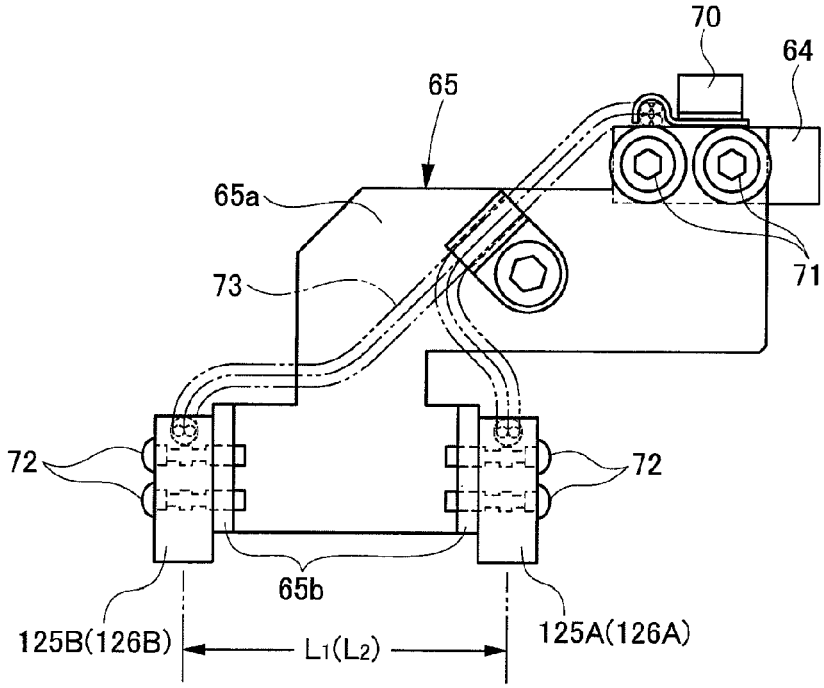
FIG. 10A is a front view of the left-hand end detectors and the right-hand end detectors.
Figure 10B:
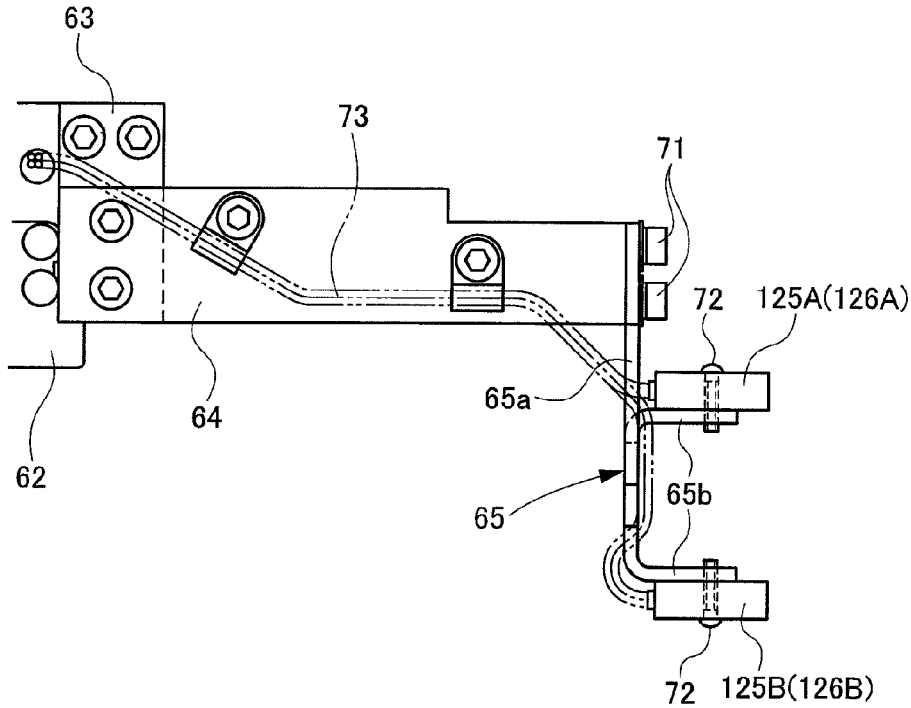
FIG. 10B is a plan view of the left-hand end detectors and the right-hand end detectors.

FIGS. 1A and 1B are hardware block diagrams of a control device for left-hand end detectors, right-hand end detectors, a left-hand side lay device moving motor, and a right-hand side lay device moving motor in an embodiment of the present invention. FIGS. 2A to 2C are action flow charts of the control device for the left-hand end detectors, the right-hand end detectors, the left-hand side lay device moving motor, and the right-hand side lay device moving motor in the embodiment of the present invention. FIGS. 3A and 3B are action flow charts of the control device for the left-hand end detectors, the right-hand end detectors, the left-hand side lay device moving motor, and the right-hand side lay device moving motor in the embodiment of the present invention. FIG. 4 is a schematic configurational drawing of a sheet-fed printing press. FIG. 5 is a plan view of a registering section. FIG. 6 is a sectional view taken on line A-A in FIG. 5. FIG. 7 is a view taken in the direction of an arrow B in FIG. 5. FIG. 8 is a sectional view taken on line C-C in FIG. 5. FIG. 9 is a sectional view taken on line D-D in FIG. 8. FIG. 10A is a front view of the left-hand end detectors and the right-hand end detectors. FIG. 10B is a plan view of the left-hand end detectors and the right-hand end detectors.

With the sheet-fed printing press, as shown in FIG. 4, paper (sheet) W fed out of a feeder 10 is once stopped by front lays 11, and then pulled by a left-hand side lay device 12A or a right-hand side lay device 12B, whereby the sheet is positioned at a position regulated by the front lays and side lays. That is, the sheet is registered in the circumferential direction and the lateral direction.

Then, the sheet is gripped by grippers of a swing 13, passed on to an impression cylinder 15 of a first printing unit 14*a* in a printing apparatus 14, and printed in a first color with ink transferred by a plate cylinder 16 to a blanket cylinder 17. The sheet W printed in the first color is sent to a second printing unit 14*b* via an intermediate cylinder 18, and printed in a second color there. Then, the sheet is transferred from a transfer cylinder 19 to a receiving cylinder 20, gripped by grippers of a transport chain 21 there, and delivered by a delivery apparatus 22.

The registering section mentioned above has a feedboard 32 laid sideways between left and right machine frames 30 via brackets 31, as shown in FIG. 5. A stay 33 is located above the feedboard 32, and laid sideways between the left and right machine frames 30. On this stay 33, a plurality of leaf springs 35 for suppressing the instability of sheets are supported in the lateral direction via brackets 34. The aforementioned front lays 11 are arranged at a plurality of locations in the lateral direction in proximity to the front end of the feedboard 32, and can each move forward and backward to the position of use and the position of retreat.

As shown in FIGS. 6 to 9 as well, a camshaft 36, which is connected to a shaft on the drive side by a coupling (not shown) and is rotated thereby, is rotatably mounted between the left and right machine frames 30. A corner stay 37 is fixed at both ends to the machine frames 30 and is mounted directly above the camshaft 36.

The above-mentioned left-hand and right-hand side lay devices 12A, 12B are formed exactly symmetrically, and are supported by the camshaft 36 and the corner stay 37 in proximity to the left and right machine frames 30. Photoelectric end detectors for detecting a folded corner of the sheet W are integrally assembled to the left-hand and right-hand side lay devices 12A, 12B. That is, a first left-hand end detector 125A and a second left-hand end detector 125B are supported, with a predetermined distance $L_1$ therebetween in the lateral direction, in the left-hand side lay device 12A, while a first right-hand end detector 126A and a second right-hand end detector 126B are supported, with a predetermined distance $L_2$ therebetween in the lateral direction, in the right-hand side lay device 12B (see FIG. 5).

A paper guide portion 37*a* in the shape of a horizontal plate is fixedly provided at the middle of the corner stay 37 in the lateral direction. Between the paper guide portion 37*a* and the left-hand side lay device 12A and similarly between the paper guide portion 37*a* and the right-hand side lay device 12B, paper guides 38A, 38B are interposed, respectively, which can extend and contract in the lateral direction when guided by the corner stay 37, and which are hexagonal in shape when viewed in plan (see FIG. 5).

The left-hand and right-hand side lay devices 12A and 12B of the same structure are arranged symmetrically on the corner stay 37, with the paper guides 38A, 38B being interposed therebetween. Thus, their concrete structure will be described by way of the left-hand side lay device 12A.

A paper bearing block 40 of the left-hand side lay device 12A is formed by a body 40*a* and an upper plate 40*b*. The upper plate 40*b* is bolted to the body 40*a* for integration, and the so assembled paper bearing block 40 is fitted on the corner stay 37 (see FIGS. 6 and 9). An inner race of a cam 41 having cam surfaces 41*a*, 41*b* composed of a crest part and a root part on the outer periphery of their opposite end surfaces is fixed to the camshaft 36. An outer race of the cam 41 is fitted and fixed to a circular boss formed in the body 40*a* of the paper bearing block 40.

The numeral 42 in FIGS. 6 and 8 denotes a paper bearing roller which has a part of its outer periphery inserted into a hole provided in the upper plate 40*b* of the paper bearing block 40, and which is pivotally supported by a bearing part of the paper bearing block 40. The paper bearing roller 42 is located such that its upper end is at the same height as the surface of the upper plate 40*b*, and a cam follower 43 opposing and contacting the cam surface 41*b* of the cam 41 is pivotally attached to the outer periphery of the paper bearing roller 42.

A tension spring 45 for imparting a pivoting force in a direction, in which the cam follower 43 is brought into pressure contact with the cam surface 41*b*, to the paper bearing roller 42 is stretched between the pivot of the cam follower 43 and a spring hook 44 protruding from the body 40*a* of the paper bearing block 40. As the cam 41 is rotated together with the camshaft 36, the paper bearing roller 42 pivots in a reciprocating manner with a predetermined cycle, as indicated by a double-headed arrow F in FIG. 8, while extending and contracting the tension spring 45.

A horizontal roller arm 46 and a trifurcated cam lever 47 are pivotably supported, in an overlapping state so as to be in the same phase forwardly and rearwardly, by a bearing portion 40*c* provided in the paper bearing block 40 (see FIG. 8). A press roller 48 pivotally attached to a free end part of the roller arm 46 is located directly above the paper bearing roller 42 and is in opposed contact therewith. A cam follower 49 pivotally attached to a lower end part of the cam lever 47 is allowed to oppose and contact the cam surface 41*a* of the cam 41 (see FIG. 9).

Between the roller arm 46 and the cam lever 47, a helical compression spring 50 is interposed for urging them in such a manner as to pivot them in opposite directions. A pin 51 with a knob, which restrains the pivotal motion due to this urging, is pivotably fitted on the roller arm 46 while having a front end in contact with the cam lever 47 (see FIG. 8).

In FIG. 8, the numeral 52 denotes a bolt screwed into the roller arm 46 to adjust the urging force of the helical compression spring 50, and the numeral 53 denotes a nut for fixing the bolt 52 at an adjusting position. The numeral 54 denotes a guide bolt screwed into the roller arm 46, and has a front end part engaged into a hole of the cam lever 47. A fixing nut 55 is screwed on the guide bolt 54.

Below a horizontal free end part of the cam lever 47, a helical compression spring 56 is loaded into a hole of the body 40*a* of the paper bearing block 40, thereby imparting a pivoting force in a direction, in which the cam follower 49 is pressed against the cam surface 41*a* of the cam 41, to the cam lever 47. On the other hand, a press plate 57 opposing and contacting the upper plate 40*b* of the paper bearing block 40 is integrally formed in a front end part of the roller arm 46. The sheet W is to be inserted between the press plate 57 and the upper plate 40*b*. In FIG. 8, the numeral 58 denotes a side lay (gauge) which brings the side edge of the sheet W into contact therewith for performing registration in the lateral direction.

As shown in FIG. 8, the front end part of the pin 51 with the knob is provided with a stopper 59, which restricts the press roller 48 during the use of drive side lays (i.e., when the left-hand side lay device 12A is not used) to a non-operating state, such that the stopper 59 intersects the pin 51 at right angles. In detail, the stopper 59 is situated in an elongated groove 46*a* in the lower surface of the roller arm 46, during the use of operate side lays (when the left-hand side lay device 12A is used), to bring the press roller 48 into opposed contact with the paper bearing roller 42. During the use of the drive side lays, however, the stopper 59 is rotated through 90 degrees after its escape from within the elongated groove 46*a*, and is located at a general portion 46*b* in the lower surface of the roller arm 46. By so doing, the roller arm 46 is forcibly pivoted counterclockwise, as indicated by chain lines in the drawing, with respect to the cam lever 47 to separate the press roller 48 from the paper bearing roller 42, thereby bringing the press roller 48 into the non-operating state. In the illustrated embodiment, a shallow groove 46*c* orthogonal to the elongated groove 46*a* is formed in the general portion 46*b* in the lower surface of the roller arm 46, thus enabling the stopper 59 to be positioned during the use of the drive side lays.

Because of the above-described configuration, when sheet feeding is started, the cam 41 is rotated together with the camshaft 36, so that the paper bearing roller 42 is pivoted in a reciprocating manner in the direction of the double-headed arrow F in FIG. 8, at a rate of one reciprocation per rotation of the cam 41, by the action of the cam surface 41*b*. Also, the cam lever 47 is pivoted in a reciprocating manner, while extending and contracting the helical compression spring 56, at a rate of one reciprocation per rotation of the cam 41, by the action of the cam surface 41*a*. Under the urging force of the helical compression spring 50, therefore, the roller arm 46 having the pin 51 in contact with the cam lever 47 also swings integrally. Thus, the press roller 48 is elevated or lowered in such a manner as to contact or leave the paper bearing roller 42.

When the press roller 48 is raised and the press plate 57 and the upper plate 40*b* are open, the sheet W is fed onto the feedboard 32, and inserted between the press plate 57 and the upper plate 40*b*. Simultaneously, the press roller 48 lowers, and the paper bearing roller 42 is pivoted counterclockwise in FIG. 8. Thus, the sheet W is held between both rollers 48 and 42, and moved leftward in FIG. 8, with the result that its side edge is brought into contact with the side lay 58, whereby lateral registration is achieved. Prior to this action, the sheet W has its front end making contact with the front lays 11, whereby its circumferential registration is achieved. Then, when the press roller 48 ascends next time, the sheet W is gripped by the grippers of the swing 13, and carried away into the first printing unit 14*a* of the printing apparatus 14. At the same time, a next sheet W is fed in, and the aforementioned action is repeated. The foregoing is a brief explanation for the side lay device. Its detailed explanation will be omitted, because the side lay device is of nearly the same configuration as that of the side lay device disclosed in Patent Document 3 by the present applicant.

When the reverse side of the sheet W printed in the above manner is to be printed, the sheets W piled in the delivery apparatus 22 are turned upside down, as such, after printing, and moved to the feeder 10. Then, they are fed, one by one, and have the reverse side printed. In this case, the edge of the sheet, which serves as a reference for registration by the left-hand and right-hand side lay devices 12A, 12B, comes to the side opposite to the side in the case of printing on the face side. Thus, switching from the operate side lay mode to the drive side lay mode must be performed.

Thus, the left-hand side lay device 12A is moved to the retreat position by a left-hand side lay device moving mechanism and a left-hand side lay device moving drive source to be described later. Also, the press roller 48 is switched from an operating state to the non-operating state by the aforementioned method. On the other hand, the right-hand side lay device 12B is moved to the use position, conformed to the paper size, by a right-hand side lay device moving mechanism and a right-hand side lay device moving drive source. Also, the press roller 48 is switched from the non-operating state to the operating state, as stated earlier. The retreat position is also determined in accordance with the paper size, because the photoelectric detectors 125A, 125B and 126A, 126B for detecting a folded corner of the sheet W are integrally assembled to the left-hand and right-hand side lay devices 12A and 12B, as mentioned above.

A threaded part of a threaded shaft 61, whose opposite end parts are pivotally supported by one of the machine frames 30 and a bearing of a bearing plate end part (not shown) of the middle of the stay 37 in parallel with the camshaft 36 and the stay 37, is screwed into a threaded bore of an internally threaded member 60 fixed, adjacent to the camshaft 36, to the body 40*a* of the paper bearing block 40 of the left-hand and the right-hand side lay device 12A, 12B (see FIGS. 6 and 9). These internally threaded members 60 and threaded shafts 61 constitute the left-hand side lay device moving mechanism and the right-hand side lay device moving mechanism mentioned above.

A left-hand side lay device moving motor (left-hand side lay device moving drive source) 130 and a right-hand side lay device moving motor (right-hand side lay device moving drive source) 134, as rotational drive means for the respective threaded shafts 61, are fixed to the bearing plate, together with a rotary encoder 132 for the left-hand side lay device moving motor and a rotary encoder 136 for the right-hand side lay device moving motor which are couplingly driven by the motors 130, 134 (see FIG. 1B).

Thus, when the left-hand side lay device moving motor 130 and the right-hand side lay device moving motor 134 are rotated, the threaded shafts 61 are rotated. Since the threaded shafts 61 and the internally threaded members 60 are screwed to each other, the left-hand side lay device 12A and the right-hand side lay device 12B, as a whole, are moved on the stay 37 independently, and positioned at predetermined positions in accordance with the paper size. The foregoing is a brief explanation for the left-hand and right-hand side lay device moving mechanisms and the left-hand and right-hand side lay device moving drive sources. Their detailed explanation will be omitted, because these members are of nearly the same configuration as that of those disclosed in Patent Document 2 by the present applicant.

In the present embodiment, as shown in FIGS. 6 and 7, the first left-hand end detector 125A and the second left-hand end detector 125B mentioned above are integrally mounted on the paper bearing block 40 of the left-hand side lay device 12A via a support block 62, an L-bracket 63, a support frame 64, and a mounting plate 65. Of course, the first right-hand end detector 126A and the second right-hand end detector 126B are similarly mounted on the paper bearing block 40 of the right-hand side lay device 12B. Thus, the paper bearing block 40 of the left-hand side lay device 12A will be taken as an example for detailed description.

The support block 62 is bonded to the body 40*a* of the paper bearing block 40 by a bolt 66 through the upper plate 40*b*. A photoelectric sensor 68, which detects the presence or absence of the sheet W having the side edge make contact with the side lay 58, is mounted on the support block 62 via a bracket 67. The L-bracket 63 has a vertical plate part bonded to the support block 62 by a bolt 69, and has a horizontal plate part bonded to a base end part of the support frame 64 by bolts 70. The mounting plate 65 is bonded to the front end surface of the support frame 64 by bolts 71. As shown in FIGS. 10A and 10B, the mounting plate 65 consists of a base plate portion 65*a* and a bifurcated plate portion 65*b*, and the first left-hand end detector 125A and the second left-hand end detector 125B are bonded to left and right side surface parts of the bifurcated plate portion 65*b* by bolts 72.

Detection signals from the first left-hand end detector 125A and the second left-hand end detector 125B are inputted via a lead wire 73 to a control device 100 to be described later. The photoelectric end detector for detecting the folded corner of the sheet W has been briefly described. Its detailed explanation will be omitted, because this detector is of nearly the same configuration as that of the detector disclosed in Patent Document 1 by the present applicant.

The lateral distance $L_1$ between the first left-hand end detector 125A and the second left-hand end detector 125B has been set beforehand at a distance by which the left-hand side lay device 12A is allowed to escape from the left edge of the sheet W when the sheet W is regulated by the right-hand side lay device 12B for lateral registration. The lateral distance $L_2$ between the first right-hand end detector 126A and the second right-hand end detector 126B has been set beforehand at a distance by which the right-hand side lay device 12B is allowed to escape from the right edge of the sheet W when the sheet W is regulated by the left-hand side lay device 12A for lateral registration.

In the present embodiment, when the left-hand side lay device 12A is selected from the pair of side lay devices, the control device 100 detects a folded corner of the sheet W from signals from the first left-hand end detector 125A supported by the left-hand side lay device 12A and the second right-hand end detector 126B supported by the right-hand side lay device 12B. The control device 100 also drivingly controls the left-hand side lay device moving motor 130 to move the left-hand side lay device 12A to a position conformed to the paper size of the sheet W, and drivingly controls the right-hand side lay device moving motor 134 to move the right-hand side lay device 12B to a position where the second right-hand end detector 126E can detect a right end part of the sheet W. When the right-hand side lay device 12B is selected, the control device 100 detects a folded corner of the sheet W from signals from the first right-hand end detector 126A supported by the right-hand side lay device 12B and the second left-hand end detector 125B supported by the left-hand side lay device 12A. The control device 100 also drivingly controls the right-hand side lay device moving motor 134 to move the right-hand side lay device 12B to a position conformed to the paper size of the sheet W, and drivingly controls the left-hand side lay device moving motor 130 to move the left-hand side lay device 12A to a position where the second left-hand end detector 125B can detect a left end part of the sheet W.

Moreover, the control device 100 drivingly controls the left-hand side lay device moving motor 130 and the right-hand side lay device moving motor 134 so that the position of the right-hand side lay device 12B when the left-hand side lay device 12A is selected will be a position corresponding to {(the position of the right-hand side lay device 12B conformed to the length in the lateral direction of the sheet W)−(the distance $L_2$ in the lateral direction between the first right-hand end detector 126A and the second right-hand end detector 1268)} and that the position of the left-hand side lay device 12A when the right-hand side lay device 12B is selected will be a position corresponding to {(the position of the left-hand side lay device 12A conformed to the length in the lateral direction of the sheet W)−(the distance $L_1$ in the lateral direction between the first left-hand end detector 125A and the second left-hand end detector 125B)}.

As shown in FIGS. 1A and 1B, the control device 100 is composed of CPU 101, ROM 102, RAM 103, input/output devices 104 to 113, and an interface 114 which are interconnected by BUS (bus line).

To the BUS, the following memories are connected: a memory M100 for storing the selected side lay device; a memory M101 for storing the paper size; a memory M102 for storing the printing speed; a memory M103 for storing a table of conversion from the paper size to the left-hand side lay device position; a memory M104 for storing the left-hand side lay device position conformed to the paper size; a memory M105 for storing a table of conversion from the paper size to the right-hand side lay device position; a memory M106 for storing the right-hand side lay device position conformed to the paper size; a memory M107 for storing the distance by which the side lay device is allowed to escape from the paper edge; a memory M108 for storing the target left-hand side lay device position; and a memory M109 for storing the target right-hand side lay device position.

To the BUS, the following memories are also connected: a memory M110 for storing the count value of a left-hand side lay device position detecting counter; a memory M111 for storing the current left-hand side lay device position; a memory M112 for storing the count value of a right-hand side lay device position detecting counter; a memory M113 for storing the current right-hand side lay device position; a memory M114 for storing the count value of a printing press rotational phase detecting counter; a memory M115 for storing the current printing press rotational phase; and a memory M116 for storing the folded corner detecting phase.

To the input/output device 104, the following are connected: a left-hand side lay device selection switch 115; a right-hand side lay device selection switch 116; a preset start switch 117; a print start switch 118; a print stop switch 119; an input device 120; a display unit 121; and an output device 122 including a floppy (registered trademark) disk drive, a printer, and the like.

To the input/output device 105, the following are connected: a paper size setting unit 123; and a printing speed setting unit 124. To the input/output device 106, the following are connected: the first left-hand end detector 125A; the second left-hand end detector 125B; the first right-hand end detector 126A; and the second right-hand end detector 126B.

To the input/output device 107, the left-hand side lay device moving motor 130 is connected via a left-hand side lay device moving motor driver 129. To the input/output device 108, a rotary encoder 132 for the left-hand side lay device moving motor, which is couplingly driven by the left-hand side lay device moving motor 130, is connected via a left-hand side lay device position detecting counter 131.

To the input/output device 109, the right-hand side lay device moving motor 134 is connected via a right-hand side lay device moving motor driver 133. To the input/output device 110, a rotary encoder 136 for the right-hand side lay device moving motor, which is couplingly driven by the right-hand side lay device moving motor 134, is connected via a right-hand side lay device position detecting counter 135.

To the input/output device 111, a home position detector 137 for the right-hand side lay device and a home position detector 138 for the left-hand side lay device are connected. In response to their detection signals, the right-hand side lay device position detecting counter 135 and the left-hand side lay device position detecting counter 131 are reset.

To the input/output device 112, a drive motor 141 is connected via a D/A converter 139 and a drive motor driver 140.

To the input/output device 113, a rotary encoder 143 for the drive motor, which is couplingly driven by the drive motor 141, is connected via a printing press rotational phase detecting counter 142. The rotary encoder 143 for the drive motor is also connected to the drive motor driver 140. The printing press rotational phase detecting counter 142 is reset by a detection signal from a home position detector 144 for the printing press which is annexed to the drive motor 141.

To the interface 114, the feeder 10 and the printing apparatus 14 are connected.

The actions of the first left-hand end detector 125A, the second left-hand end detector 125B, the first right-hand end detector 126A, the second right-hand end detector 126B, the left-hand side lay device moving motor 130, and the right-hand side lay device moving motor 134 mentioned above will be described below.

The control device 100 operates in accordance with the action flow shown in FIGS. 2A to 2C, FIG. 3A and FIG. 3B.

In Step P1, it is determined whether the left-hand side lay device selection switch 115 is ON. If the answer is yes (YES), the memory M100 for storing the selected side lay device is overwritten with 1 in Step P2. Then, the program shifts to Step P3. If the answer is no (NO) in Step P1, the program directly shifts to Step P3.

Then, in Step P3, it is determined whether the right-hand side lay device selection switch 116 is ON. If the answer is yes (YES), the memory M100 for storing the selected side lay device is overwritten with 2 in Step P4. Then, the program shifts to Step P5. If the answer is no (NO) in Step P3, the program directly shifts to Step P5.

Then, in Step P5, it is determined whether there has been an input to the paper size setting unit 123. If the answer is YES, the value inputted to the paper size setting unit 123 is loaded, and the memory M101 for storing the paper size is overwritten with this value, in Step P6. Then, the program shifts to Step P7. If the answer is NO in Step P5, the program directly shifts to Step P7.

Then, in Step P7, it is determined whether there has been an input to the printing speed setting unit 124. If the answer is YES, the value inputted to the printing speed setting unit 124 is loaded, and the memory M102 for storing the printing speed is overwritten with this value, in Step P8. Then, the program shifts to Step P9. If the answer is NO in Step P7, the program directly shifts to Step P9.

Then, in Step P9, it is determined whether the preset start switch 117 is ON. If the answer is YES, in Step P10, the table of conversion from the paper size to the left-hand side lay device position is loaded from the memory M103 for storing the table of conversion from the paper size to the left-hand side lay device position. If the answer is NO in Step P9, the programs return to Step P1.

Then, in Step P11, the paper size is loaded from the memory M101 for storing the paper size. Then, in Step P12, the left-hand side lay device position conformed to the paper size is computed from the paper size with the use of the table of conversion from the paper size to the left-hand side lay device position, and stored into the memory M104 for storing the left-hand side lay device position conformed to the paper size.

Then, in Step P13, the table of conversion from the paper size to the right-hand side lay device position is loaded from the memory M105 for storing the table of conversion from the paper size to the right-hand side lay device position. Then, in Step P14, the paper size is loaded from the memory M101 for storing the paper size.

Then, in Step P15, the right-hand side lay device position conformed to the paper size is computed from the paper size with the use of the table of conversion from the paper size to the right-hand side lay device position, and stored into the memory M106 for storing the right-hand side lay device position conformed to the paper size. Then, in Step P16, the contents of the memory M100 for storing the selected side lay device are loaded.

Then, in Step P17, it is determined whether the contents of the memory for storing the selected side lay device are equal to 1. If the answer is YES, in Step P18, the left-hand side lay device position conformed to the paper size is loaded from the memory M104 for storing the left-hand side lay device position conformed to the paper size. Then, in Step P19, the memory M108 for storing the target left-hand side lay device position is overwritten with the left-hand side lay device position conformed to the paper size.

Then, in Step P20, the distance by which the side lay device is allowed to escape from the paper edge is loaded from the memory M107 for storing the distance by which the side lay device is allowed to escape from the paper edge. Then, in Step P21, the right-hand side lay device position conformed to the paper size is loaded from the memory M106 for storing the right-hand side lay device position conformed to the paper size.

Then, in Step P22, the distance by which the side lay device is allowed to escape from the paper edge is subtracted from the right-hand side lay device position conformed to the paper size to compute the target right-hand side lay device position, and the memory M109 for storing the target right-hand side lay device position is overwritten with the computed value. Then, in Step P23, a reverse rotation command is outputted to the left-hand side lay device moving motor driver 129.

Then, if the answer is NO in the aforementioned Step P17, in Step P24, the distance by which the side lay device is allowed to escape from the paper edge is loaded from the memory M107 for storing the distance by which the side lay device is allowed to escape from the paper edge. Then, in Step P25, the left-hand side lay device position conformed to the paper size is loaded from the memory M104 for storing the left-hand side lay device position conformed to the paper size.

Then, in Step P26, the distance by which the side lay device is allowed to escape from the paper edge is subtracted from the left-hand side lay device position conformed to the paper size to compute the target left-hand side lay device position, and the memory M108 for storing the target left-hand side lay device position is overwritten with the computed value. Then, in Step P27, the right-hand side lay device position conformed to the paper size is loaded from the memory M106 for storing the right-hand side lay device position conformed to the paper size.

Then, in Step P28, the memory M109 for storing the target right-hand side lay device position is overwritten with the right-hand side lay device position conformed to the paper size. Then, the program shifts to the aforementioned Step P23.

Then, if the home position detector 138 for the left-hand side lay device is ON in Step P29, Step P30 is executed to stop the reverse rotation command output to the left-hand side lay device moving motor driver 129. Then, in Step P31, a reverse rotation command is outputted to the right-hand side lay device moving motor driver 133.

Then, if the home position detector 137 for the right-hand side lay device is ON in Step P32, Step P33 is executed to stop the reverse rotation command output to the right-hand side lay device moving motor driver 133.

Then, in Step P34, a normal rotation command is outputted to the left-hand side lay device moving motor driver 129. Then, in Step P35, the count value is loaded from the left-hand side lay device position detecting counter 131, and stored into the memory M110 for storing the count value of the left-hand side lay device position detecting counter.

Then, in Step P36, the current left-hand side lay device position is computed from the count value of the left-hand side lay device position detecting counter 131, and stored into the memory M111 for storing the current left-hand side lay device position. Then, in Step P37, the target left-hand side lay device position is loaded from the memory M108 for storing the target left-hand side lay device position.

Then, in Step P38, it is determined whether the current left-hand side lay device position is equal to the target left-hand side lay device position. If the answer is YES, Step P39 is executed to stop the normal rotation command output to the left-hand side lay device moving motor driver 129. If the answer is NO, the program returns to Step P35.

Then, in Step P40, a normal rotation command is outputted to the right-hand side lay device moving motor driver 133. Then, in Step P41, the count value is loaded from the right-hand side lay device position detecting counter 135, and stored into the memory M112 for storing the count value of the right-hand side lay device position detecting counter.

Then, in Step P42, the current right-hand side lay device position is computed from the count value of the right-hand side lay device position detecting counter 135, and stored into the memory M113 for storing the current right-hand side lay device position. Then, in Step P43, the target right-hand side lay device position is loaded from the memory M109 for storing the target right-hand side lay device position.

Then, in Step P44, it is determined whether the current right-hand side lay device position is equal to the target right-hand side lay device position. If the answer is YES, Step P45 is executed to stop the normal rotation command output to the right-hand side lay device moving motor driver 133. If the answer is NO, the program returns to Step P41.

In accordance with the above-described action flow, when the left-hand side lay device 12A is selected, the left-hand side lay device moving motor 130 is drivingly controlled to move the left-hand side lay device 12A to the position conformed to the paper size of the sheet W. On the other hand, the right-hand side lay device moving motor 134 is drivingly controlled to move the right-hand side lay device 12B to the position where the second right-hand end detector 126B can detect the right end of the sheet W. When the right-hand side lay device 12B is selected, the right-hand side lay device moving motor 134 is drivingly controlled to move the right-hand side lay device 12B to the position conformed to the paper size of the sheet W. On the other hand, the left-hand side lay device moving motor 130 is drivingly controlled to move the left-hand side lay device 12A to the position where the second left-hand end detector 125B can detect the left end of the sheet W.

That is, as shown in FIG. 5, if the left-hand side lay device 12A is selected, when the left-hand side lay device 12A is positioned at the position conformed to the paper size of the sheet W, the first left-hand end detector 125A can detect the left end of the sheet W. When the right-hand side lay device 12B is positioned at a right-hand location closer to the home position, than the position conformed to the paper size of the sheet W, by the lateral distance $L_2$ between the first right-hand end detector 126A and the second right-hand end detector 126B, the second right-hand end detector 126B can detect the right end of the sheet W. Conversely, if the right-hand side lay device 12B is selected, when the right-hand side lay device 12B is positioned at the position conformed to the paper size of the sheet W, the first right-hand end detector 126A can detect the right end of the sheet W. When the left-hand side lay device 12A is positioned at a left-hand location closer to the home position, than the position conformed to the paper size of the sheet W, by the lateral distance $L_1$ between the first left-hand end detector 125A and the second left-hand end detector 125B, the second left-hand end detector 125B can detect the left end of the sheet W. In this embodiment, the distance $L_1$=the distance $L_2$, and this value is set as the distance by which the side lay device is allowed to escape from the sheet edge.

Then, if the print start switch 118 is ON in Step P46, Step P47 is executed to load the printing speed from the memory M102 for storing the printing speed.

Then, in Step P48, the printing speed is outputted to the drive motor driver 140 via the D/A converter 139. Then, in Step P49, a feed start command is transmitted to the feeder 10 and, in Step P50, a print start command is transmitted to the printing apparatus 14.

Then, in Step P51, the count value is loaded from the printing press rotational phase detecting counter 142, and stored into the memory M114 for storing the count value of the printing press rotational phase detecting counter. Then, in Step P52, the current rotational phase of the printing press is computed from the count value of the printing press rotational phase detecting counter 142, and stored into the memory M115 for storing the current printing press rotational phase.

Then, in Step P53, the folded corner detecting phase is loaded from the memory M116 for storing the folded corner detecting phase. Then, in Step P54, it is determined whether the current printing press rotational phase is equal to the folded corner detecting phase.

If the answer is YES in Step P54, the contents of the memory M100 for storing the selected side lay device are loaded in Step P55. If the answer is NO in Step P54, the program returns to Step P51.

Then, in Step P56, it is determined whether the contents of the memory for storing the selected side lay device are equal to 1. If the answer is YES, the output of the first left-hand end detector 125A is loaded in Step P57.

Then, in Step P58, it is determined whether the output of the first left-hand end detector 125A is OFF. If the answer is YES, the program shifts to Step P66 to be described later. If the answer is NO, the output of the second right-hand end detector 126B is loaded in Step P59.

Then, in Step P60, it is determined whether the output of the second right-hand end detector 126B is OFF. If the answer is YES, the program shifts to Step P66 to be described later. If the answer is NO, the program goes to Step P61.

If the answer is NO in the above-mentioned Step P56, the output of the first right-hand end detector 126A is loaded in Step P62.

Then, in Step P63, it is determined whether the output of the first right-hand end detector 126A is OFF. If the answer is YES, the program shifts to Step P66 to be described later. If the answer is NO, the output of the second left-hand end detector 125B is loaded in Step P64.

Then, in Step P65, it is determined whether the output of the second left-hand end detector 125B is OFF. If the answer is YES, the program shifts to Step P66 to be described later. If the answer is NO, the program goes to Step P61.

Then, in the above-mentioned Step P61, it is determined whether the print stop switch 119 is ON. If the answer is YES, a feed stop command is transmitted to the feeder 10 in the aforementioned Step P66. If the answer is NO, the program returns to Step P51.

Then, in Step P67, a print stop command is transmitted to the printing apparatus 14. Then, in Step P68, a stop command is outputted to the drive motor driver 140.

In accordance with the foregoing action flow, when the left-hand side lay device 12A is selected, a folded corner of the sheet W is detected based on signals from the first left-hand end detector 125A supported in the left-hand side lay device 12A and the second right-hand end detector 126B supported in the right-hand side lay device 12B. When the right-hand side lay device 12B is selected, a folded corner of the sheet W is detected based on signals from the first right-hand end detector 126A supported in the right-hand side lay device 12B and the second left-hand end detector 125B supported in the left-hand side lay device 12A.

According to the present embodiment, in the above-described manner, which of the first and second left-hand end detectors 125A, 125B should be used, and which of the first and second right-hand end detectors 126A, 126B should be used, are automatically selected in accordance with a setting of which of the left-hand and right-hand side lay devices 12A, 12B is to be used, among the pair of left-hand end detectors 125A, 125B and the pair of right-hand end detectors 126A, 1263 provided integrally with the left-hand and right-hand side lay devices 12A, 12B. Thus, the rate of operation can be increased, and the burden on the operator can be reduced.

In the above embodiment, the lateral distance $L_1$ between the first left-hand end detector 125A and the second left-hand end detector 125B, and the lateral distance $L_2$ between the first right-hand end detector 126A and the second right-hand end detector 126B have been described as the same value, and as the distance by which the side lay device is allowed to escape from the sheet edge. However, the distance $L_1$ may be set at such a distance that when the left-hand side lay device 12A is positioned at the home position, the second left-hand end detector 125B can detect the left end of the sheet W positioned by the right-hand side lay device 12B; and the distance $L_2$ may be set at such a distance that when the right-hand side lay device 12B is positioned at the home position, the second right-hand end detector 126B can detect the right end of the sheet W positioned by the left-hand side lay device 12A. In this case, as with the customary practice, if the left-hand side lay device 12A is selected, when the left-hand side lay device 12A is positioned at the position conformed to the paper size of the sheet W, the first left-hand end detector 125A can detect the left end of the sheet W. When the right-hand side lay device 12B is retreated to the right-hand home position, the second right-hand end detector 126B can detect the right end of the sheet W. Conversely, if the right-hand side lay device 12B is selected, when the right-hand side lay device 12B is positioned at the position conformed to the paper size of the sheet W, the first right-hand end detector 126A can detect the right end of the sheet W. When the left-hand side lay device 12A is retreated to the left-hand home position, the second left-hand end detector 125B can detect the left end of the sheet W. As with the customary practice, therefore, if one of the side lay devices is selected, both ends of the sheet W can be detected, even when the other side lay device remains retreated at the retreat position.

According to the present embodiment, moreover, the first left-hand end detector 125A and the second left-hand end detector 125B, and the first right-hand end detector 126A and the second right-hand end detector 126B arranged by twos on the left end side and the right end side of the sheet W are automatically moved to the detecting position by the effective use of the left-hand and right-hand side lay devices 12A, 12B when the paper size of the sheet W is changed. Thus, the rate of operation can be increased, and the burden on the operator can be reduced.

In the above embodiment, moreover, the lateral distance $L_1$ between the first left-hand end detector 125A and the second left-hand end detector 125B, and the lateral distance $L_2$ between the first right-hand end detector 126A and the second right-hand end detector 126B have been described as the same value. Needless to say, however, the distance $L_1$ and the distance $L_2$ may be set as different values in the light of relation with other members at the installation position and so on.

It goes without saying that the present invention is not limited to the foregoing embodiment, but various changes and modifications, such as changes in the structures of the side lay devices and the moving mechanisms, may be made without departing from the gist of the present invention.

Reference Signs List

| | |
|---|---|
| 10 | Feeder |
| 11 | Front lay |
| 12A | Left-hand side lay device |
| 12B | Right-hand side lay device |
| 13 | Swing |
| 14 | Printing apparatus |
| 15 | Impression cylinder |
| 16 | Plate cylinder |
| 17 | Blanket cylinder |
| 18 | Intermediate cylinder |
| 19 | Transfer cylinder |
| 20 | Receiving cylinder |
| 21 | Transport chain |
| 22 | Delivery apparatus |
| 30 | Machine frame |
| 31 | Bracket |
| 32 | Feedboard |
| 33 | Stay |
| 34 | Bracket |
| 35 | Leaf spring |
| 36 | Camshaft |
| 37 | Corner stay |
| 38A, 38B | Paper guide |
| 40 | Paper bearing block |
| 40a | Body |
| 40b | Upper plate |
| 40c | Bearing portion |
| 41a, 41b | Cam surface |
| 42 | Paper bearing roller |
| 43 | Cam follower |
| 44 | Spring hook |
| 45 | Tension spring |
| 46 | Roller arm |
| 46a | Elongated groove |
| 46b | General portion |
| 46c | Shallow groove |
| 47 | Cam lever |
| 48 | Press roller |
| 49 | Cam follower |
| 50 | Helical compression spring |
| 51 | Pin with knob |
| 52 | Bolt |
| 53 | Nut |
| 54 | Guide bolt |
| 55 | Nut |
| 57 | Press plate |
| 58 | Side lay |

-continued

| Reference Signs List | |
|---|---|
| 59 | Stopper |
| 60 | Internally threaded member |
| 61 | Threaded shaft |
| 62 | Support block |
| 63 | L-bracket |
| 64 | Support frame |
| 65 | Mounting plate |
| 65a | Base plate portion |
| 65b | Bifurcated plate portion |
| 66 | Bolt |
| 67 | Bracket |
| 68 | Sensor |
| 69 | Bolt |
| 70 | Bolt |
| 71 | Bolt |
| 72 | Bolt |
| 73 | Lead wire |
| 100 | Control device |
| 125A | First left-hand end detector |
| 125B | Second left-hand end detector |
| 126A | First right-hand end detector |
| 126B | Second right-hand end detector |
| 130 | Left-hand side lay device moving motor |
| 134 | Right-hand side lay device moving motor |
| 141 | Drive motor |
| W | Sheet |

$L_1$ Distance in lateral direction between first left-hand end detector and second left-hand end detector $L_2$ Distance in lateral direction between first right-hand end detector and second right-hand end detector

The invention claimed is:

1. A method for detecting a folded corner of a sheet in a sheet-fed printing press, the sheet-fed printing press including:

a left-hand side lay device for registering a left end position of sheets supplied from a feeder to a printing unit, a right-hand side lay device for registering a right end position of sheets supplied from the feeder to the printing unit, and a detector for detecting presence or absence of the sheet at a left end part and a right end part of a front end of the sheet whose position has been registered by one of the side lay devices, the method comprising providing the detector including:

a first left-hand end detector supported in the left-hand side lay device, a second left-hand end detector supported in the left-hand side lay device and provided at a position spaced from the first left-hand end detector toward a center in a lateral direction, a first right-hand end detector supported in the right-hand side lay device, and a second right-hand end detector supported in the right-hand side lay device and provided at a position spaced from the first right-hand end detector toward the center in the lateral direction, wherein if the left-hand side lay device is selected among a pair of the side lay devices, the first left-hand end detector supported in the left-hand side lay device and the second right-hand end detector supported in the right-hand side lay device detect the presence or absence of the sheet at the left end part and the right end part of the front end of the sheet, or if the right-hand side lay device is selected, the first right-hand end detector supported in the right-hand side lay device and the second left-hand end detector supported in the left-hand side lay device detect the presence or absence of the sheet at the right end part and the left end part of the front end of the sheet.

2. The method for detecting a folded corner of a sheet in a sheet-fed printing press according to claim 1, further comprising providing:

a left-hand side lay device moving mechanism for moving the left-hand side lay device in the lateral direction, a left-hand side lay device moving drive source for driving the left-hand side lay device moving mechanism, a right-hand side lay device moving mechanism for moving the right-hand side lay device in the lateral direction, and a right-hand side lay device moving drive source for driving the right-hand side lay device moving mechanism, wherein if the left-hand side lay device is selected among the pair of the side lay devices, the first left-hand end detector supported in the left-hand side lay device and the second right-hand end detector supported in the right-hand side lay device detect the presence or absence of the sheet at the left end part and the right end part of the front end of the sheet, the left-hand side lay device moving drive source moves the left-hand side lay device to a position conformed to a length in the lateral direction of the sheet, and the right-hand side lay device moving drive source moves the right-hand side lay device to a position where the second right-hand end detector can detect the right end part of the sheet; or if the right-hand side lay device is selected, the first right-hand end detector supported in the right-hand side lay device and the second left-hand end detector supported in the left-hand side lay device detect the presence or absence of the sheet at the right end part and the left end part of the front end of the sheet, the right-hand side lay device moving drive source moves the right-hand side lay device to a position conformed to the length in the lateral direction of the sheet, and the left-hand side lay device moving drive source moves the left-hand side lay device to a position where the second left-hand end detector can detect the left end part of the sheet.

3. The method for detecting a folded corner of a sheet in a sheet-fed printing press according to claim 2, wherein the position of the right-hand side lay device if the left-hand side lay device is selected is a position defined by {(the position of the right-hand side lay device conformed to the length in the lateral direction of the sheet)−(a distance in the lateral direction between the first right-hand end detector and the second right-hand end detector)}, and the position of the left-hand side lay device if the right-hand side lay device is selected is a position defined by {(the position of the left-hand side lay device conformed to the length in the lateral direction of the sheet)−(a distance in the lateral direction between the first left-hand end detector and the second left-hand end detector)}.

4. The method for detecting a folded corner of a sheet in a sheet-fed printing press according to claim 2, wherein a distance in the lateral direction between the first right-hand end detector and the second right-hand end detector is a distance by which the right-hand side lay device is allowed to escape from a right edge of the registered sheet if the left-hand side lay device is selected, and a distance in the lateral direction between the first left-hand end detector and the second left-hand end detector is a distance by which the left-hand side lay device is allowed to escape from a left edge of the registered sheet if the right-hand side lay device is selected.

5. An apparatus for detecting a folded corner of a sheet in a sheet-fed printing press, the sheet-fed printing press including:

a left-hand side lay device for registering a left end position of sheets supplied from a feeder to a printing unit, a right-hand side lay device for registering a right end position of sheets supplied from the feeder to the printing unit, and a detector for detecting presence or absence of the sheet at a left end part and a right end part of a front end of the sheet whose position has been registered by one of the side lay devices, the apparatus comprising the detector including:

a first left-hand end detector supported in the left-hand side lay device, a second left-hand end detector supported in the left-hand side lay device and provided at a position spaced from the first left-hand end detector toward a center in a lateral direction, a first right-hand end detector supported in the right-hand side lay device, and a second right-hand end detector supported in the right-hand side lay device and provided at a position spaced from the first right-hand end detector toward the center in the lateral direction, the apparatus further comprising:

a control device which exercises control such that if the left-hand side lay device is selected among a pair of the side lay devices, the first left-hand end detector supported in the left-hand side lay device and the second right-hand end detector supported in the right-hand side lay device detect the presence or absence of the sheet at the left end part and the right end part of the front end of the sheet, or if the right-hand side lay device is selected, the first right-hand end detector supported in the right-hand side lay device and the second left-hand end detector supported in the left-hand side lay device detect the presence or absence of the sheet at the right end part and the left end part of the front end of the sheet.

6. The apparatus for detecting a folded corner of a sheet in a sheet-fed printing press according to claim 5, further comprising:

a left-hand side lay device moving mechanism for moving the left-hand side lay device in the lateral direction, a left-hand side lay device moving drive source for driving the left-hand side lay device moving mechanism, a right-hand side lay device moving mechanism for moving the right-hand side lay device in the lateral direction, and a right-hand side lay device moving drive source for driving the right-hand side lay device moving mechanism, wherein if the left-hand side lay device is selected among the pair of the side lay devices, the control device detects the presence or absence of the sheet at the left end part and the right end part of the front end of the sheet based on signals from the first left-hand end detector supported in the left-hand side lay device and the second right-hand end detector supported in the right-hand side lay device, drivingly controls the left-hand side lay device moving drive source to move the left-hand side lay device to a position conformed to a length in the lateral direction of the sheet, and drivingly controls the right-hand side lay device moving drive source to move the right-hand side lay device to a position where the second right-hand end detector can detect the right end part of the sheet; or if the right-hand side lay device is selected, the control device detects the presence or absence of the sheet at the right end part and the left end part of the front end of the sheet based on signals from the first right-hand end detector supported in the right-hand side lay device and the second left-hand end detector supported in the left-hand side lay device, drivingly controls the right-hand side lay device moving drive source to move the right-hand side lay device to a position conformed to the length in the lateral direction of the sheet, and drivingly controls the left-hand side lay device moving drive source to move the left-hand side lay device to a position where the second left-hand end detector can detect the left end part of the sheet.

7. The apparatus for detecting a folded corner of a sheet in a sheet-fed printing press according to claim 6, wherein the control device drivingly controls the left-hand side lay device moving drive source and the right-hand side lay device moving drive source such that the position of the right-hand side lay device if the left-hand side lay device is selected is a position defined by {(the position of the right-hand side lay device conformed to the length in the lateral direction of the sheet)−(a distance in the lateral direction between the first right-hand end detector and the second right-hand end detector)}, and the position of the left-hand side lay device if the right-hand side lay device is selected is a position defined by {(the position of the left-hand side lay device conformed to the length in the lateral direction of the sheet)−(a distance in the lateral direction between the first left-hand end detector and the second left-hand end detector)}.

8. The apparatus for detecting a folded corner of a sheet in a sheet-fed printing press according to claim 6, wherein a distance in the lateral direction between the first right-hand end detector and the second right-hand end detector is a distance by which the right-hand side lay device is allowed to escape from a right edge of the registered sheet if the left-hand side lay device is selected, and a distance in the lateral direction between the first left-hand end detector and the second left-hand end detector is a distance by which the left-hand side lay device is allowed to escape from a left edge of the registered sheet if the right-hand side lay device is selected.

* * * * *